US007432670B2

(12) United States Patent
Yamashita et al.

(10) Patent No.: US 7,432,670 B2
(45) Date of Patent: Oct. 7, 2008

(54) DEVICE FOR TURNING ON HIGH-PRESSURE DISCHARGE LAMP AND LIGHTING APPARATUS EQUIPPED WITH THE DEVICE

(75) Inventors: Koji Yamashita, Kyoto (JP); Akihiro Kishimoto, Osaka (JP); Koji Noro, Waltham, MA (US); Toshiaki Sasaki, Osaka (JP); Noriyuki Fukumori, Kyoto (JP)

(73) Assignee: Matsushita Electric Works, Ltd., Osaka (JP)

( * ) Notice: Subject to any disclaimer, the term of this patent is extended or adjusted under 35 U.S.C. 154(b) by 38 days.

(21) Appl. No.: 10/596,332

(22) PCT Filed: Nov. 24, 2004

(86) PCT No.: PCT/JP2004/017406

§ 371 (c)(1),
(2), (4) Date: Sep. 29, 2006

(87) PCT Pub. No.: WO2005/057990

PCT Pub. Date: Jun. 23, 2005

(65) Prior Publication Data

US 2007/0063659 A1 Mar. 22, 2007

(30) Foreign Application Priority Data

Dec. 12, 2003 (JP) ..... 2003-415373

(51) Int. Cl.
*H05B 37/02* (2006.01)

(52) U.S. Cl. ..... 315/362; 315/307; 315/247; 315/224; 315/289; 315/291; 315/DIG. 5

(58) Field of Classification Search ..... 315/307, 315/291, 224, 247, 246, 244, 289, 290, 360, 315/362, 209 R, 82, DIG. 5, DIG. 7; 362/507, 362/514, 515, 519, 535, 538; 174/102 R, 174/103, 104, 105 R, 99 R, 90, 34, 36
See application file for complete search history.

(56) References Cited

U.S. PATENT DOCUMENTS 4,447,763 A * 5/1984 Iyama et al. ..... 315/207

(Continued)

FOREIGN PATENT DOCUMENTS

JP 63-307695 12/1988

OTHER PUBLICATIONS

English Language Abstract of JP 63-307695.

*Primary Examiner*—Haissa Philogene
(74) *Attorney, Agent, or Firm*—Greenblum & Bernstein, P.L.C.

(57) ABSTRACT

Even if a DC output voltage of a step-down chopper circuit (3) is lowered from a value in a non-lighted state or a no-load state due to a discharge occurring between conductors (105*a*) in a cable (104), the turn on detection circuit (26*a*) can discriminates between lighted and non-lighted states without erroneously determining such a discharge as a discharge in a discharge lamp (4). This allows an operation of the timer (29) to be continued, so that high-voltage pulses are intermittently applied to prevent continuous discharge between the conductors (105) and abnormal heat generation in the cable (104). Further, even if a discharge occurs in an outer tube of the discharge lamp (4), the turn on detection circuit (26*a*) never erroneously discriminates this discharge as the lighted state. Thus, the lighting device of the present invention can suppress abnormal heat generations in the components and a socket (102).

23 Claims, 16 Drawing Sheets

U.S. PATENT DOCUMENTS 5,942,859 A * 8/1999 Okude et al. ..... 315/291
6,850,015 B2 * 2/2005 Ishizuka et al. ..... 315/224
6,967,288 B2 * 11/2005 Ohsawa et al. ..... 174/104
7,141,937 B2 * 11/2006 Kumagai et al. ..... 315/224
2006/0049777 A1 3/2006 Kumagai et al.
2006/0055341 A1 3/2006 Watanabe et al.
2006/0164842 A1 7/2006 Goriki et al.

* cited by examiner

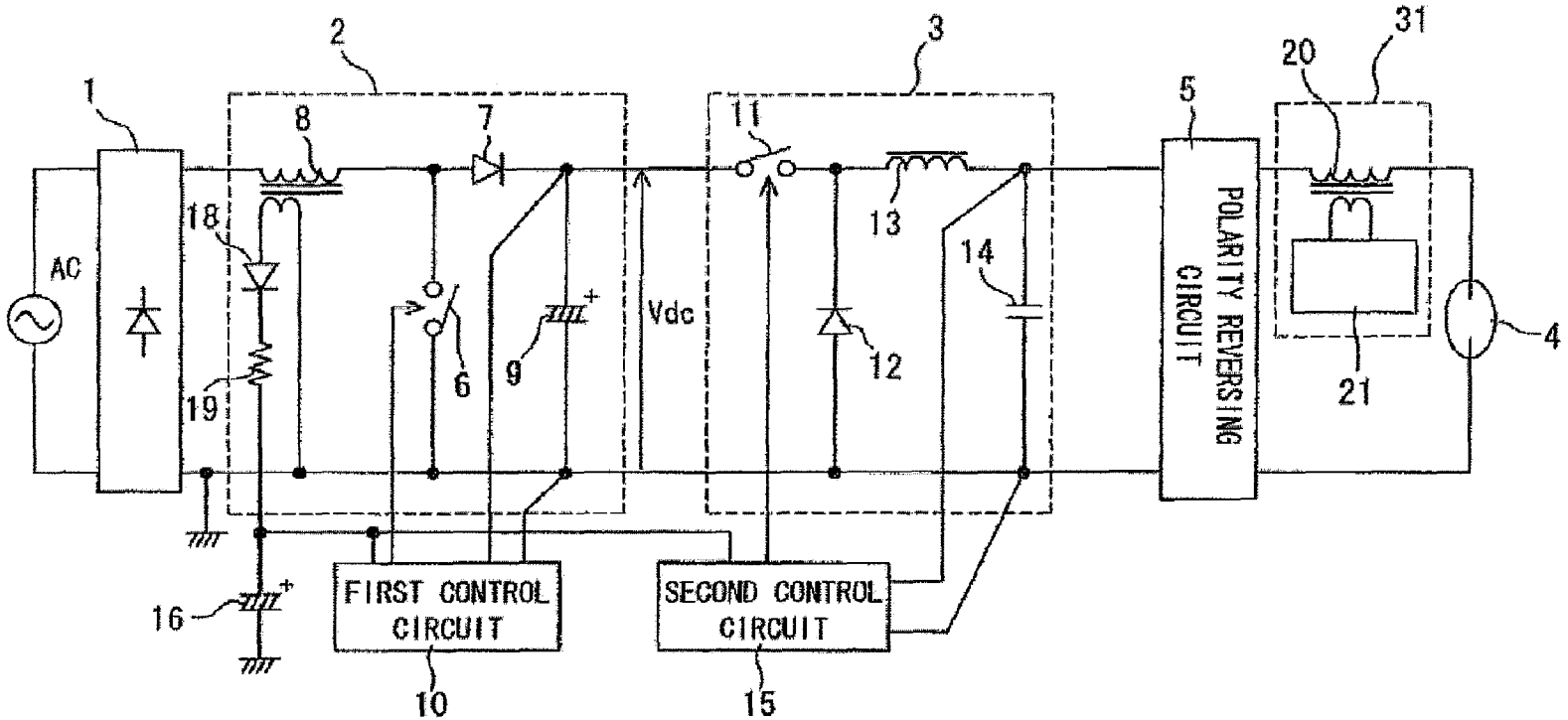
Fig. 25
CONVENTIONAL

DEVICE FOR TURNING ON HIGH-PRESSURE DISCHARGE LAMP AND LIGHTING APPARATUS EQUIPPED WITH THE DEVICE

TECHNICAL FIELD

The present invention relates to a device for turning on a high-pressure discharge lamp, such as a high-intensity discharge lamp, (hereinafter referred to as lighting device), and a lighting apparatus equipped with such a lighting device.

BACKGROUND ART

A high-intensity discharge lamp (HID lamp), which is one type of high-pressure discharge lamp, is widely used in various fields in view of high luminance intensity and selectability of high-efficiency type. Particular, in late years, a metal halide lamp is used as spotlights and downlights in indoor stores by taking advantage of its high color rendering performance. For this reason, an appearance design of a lamp fitting becomes important, and there is the need for more compact lamp fittings. Consequently, instead of a lighting apparatus with an integrated structure of a lamp fitting adapted to mount a lamp and a ballast serving as a lighting device, a lighting apparatus comprising a light fitting and a ballast disposed apart from one another and electrically connected to one another through a wiring, such as a cable, is becoming popular.

Particularly, in a lighting apparatus designed to output a high-voltage pulse from a ballast so as to start up a lamp, the high-voltage pulses continuously applied to a cable are liable to deteriorate the wiring. Thus, a wiring capable of withstanding an integral stress of the applied high-voltage pulses has to be used. This requirement is disadvantageous, for example, in terms of cost. The following Parent Publication 1 discloses a lighting device (hereinafter referred to as "conventional device 1") intended to solve such a problem.

The conventional device 1 comprises a first timer for counting a time (typically 10 seconds) required for initial start-up of a high-pressure discharge lamp (required for allowing a high-pressure discharge lamp to initially start up), a second timer for intermittently activating the first timer in constant time cycles (typically 2 minutes), and a third timer for activating each of the first and second timers for at least a time equal to or greater than a time (typically 20 minutes) required for restart of the high-pressure discharge lamp (required for allowing the high-pressure discharge lamp to have a restartable condition). The conventional device 1 is designed to activate an igniter only within the counting time of the first timer and inhibit the igniter from operating after elapse of the counting time of the third timer. That is, the conventional device 1 is designed to allow an operation of the igniter for a time sufficient for the initial start-up of the high-pressure discharge lamp to be repeatedly performed within a time sufficient for the restart of the high-pressure discharge lamp. This makes it possible to minimize the occurrence of electric noise due to the high-voltage pulses in a non-lighted state of the lamp, and the risk of deterioration of the wiring.

The conventional device 1 is a ballast using a magnetic circuit (so-called "copper-iron ballast"). Recent years, in connection with the need for reduction in weight and size and enhancement of functionality of a ballast, the mainstream of lighting devices is being shifted to an electronic ballast using a number of electronic components.

FIG. 25 is a circuit block diagram showing one example of a conventional electronic ballast (hereinafter referred to as "conventional device 2"). The conventional device 2 comprises a rectification circuit 1 for full-wave rectifying a voltage from an AC power supply AC which is a commercial power supply, a step-up chopper circuit 2 for converting a pulsating voltage rectified through the rectification circuit 1 into a desired DC voltage, a step-down chopper circuit 3 for stepping down an output DC voltage from the step-up chopper circuit 2, a polarity reversing circuit 5 for alternating an output DC voltage from the step-down chopper circuit 3 at a low frequency of several ten to several hundred Hz to apply a rectangular-wave voltage to a high-pressure discharge lamp 4 (hereinafter referred to as "discharge lamp 4"), and an igniter circuit 31 for applying start-up high-voltage pulses to the discharge lamp 4.

The step-up chopper circuit 2 has a commonly-known configuration which includes a chopper choke 8, a rectifying element 7, a switching element 6 and a smoothing capacitor 9. A first control circuit 10 is operable to PWM-control the switching element 6 so as to obtain a DC output voltage Vdc stepped up to a desired level, between both ends of the smoothing capacitor 9. The step-down chopper circuit 3 has a commonly-known configuration which includes a switching element 11, a rectifying element 12, a chopper choke 13 and a smoothing capacitor 14. A second control circuit 15 is operable to PWM-control the switching element 11 so as to obtain a DC output voltage stepped down to a desired level, between both ends of the smoothing capacitor 14. The step-up chopper circuit 2 and the step-down chopper circuit 3 each having the above configuration are commonly known, and the detailed description of their operations will be omitted.

The igniter circuit 31 includes a pulse transformer 20 having a secondary winding inserted between the polarity reversing circuit 5 and the discharge lamp 4, and a pulse generator 21 for applying a pulse voltage to a primary winding of the pulse transformer 20. The igniter circuit 31 is operable to superimpose the high-voltage pulses on the rectangular-wave voltage having a polarity reversed through the polarity reversing circuit 5 so as to start up the discharge lamp 4.

The inductor 8 of the step-up chopper circuit 2 is provided with a secondary winding. An AC voltage induced in this secondary winding is rectified, limited and smoothed, respectively, through a diode 18, a resistor 19 and a capacitor 16 to obtain an operating power for the first and second control circuits 10, 15. In this case, a voltage between both ends of the capacitor 16 can be increased up to a value equal to or greater an operating voltage of the first and second control circuits 10, 15 only if the step-up chopper circuit 2 operates to allow a current to flow through the inductor 6 at a given value or more. It is also required to stabilize an output of the capacitor 16 using a three-terminal regulator or the like.

Parent Publication 1: Japanese Patent No. 63307695

DISCLOSURE OF INVENTION

Problems to be Solved by the Invention

In the above conventional device 1, there is the risk of occurrence of scratches in the wiring or a defective connection between the lamp fitting and the cable. In this case, the igniter generates a high-voltage pulse of about 3 to 5 kV (or between 3 kV or more and 5 kV or less). Thus, if an insulator covering a conductor of the cable has a thickness of about 1.0 mm, a discharge can occur due to dielectric breakdown. Such a discharge produces a similar situation to that just after start-up of the high-pressure discharge lamp. Specifically, the operation of the igniter is stopped, and a power approximately equal to that in a steady lighted state is supplied from the copper-iron ballast through the wiring to cause the risk of an abnormal heat generation in the cable.

In a high-pressure discharge lamp, a lamp voltage tends to increase as an elapsed turn on time increases. Thus, in the copper-iron ballast as in the conventional device 1, an increase in restart voltage due to the increased lamp voltage is likely to cause difficulty in maintaining the lighted state and lead to fading-out. As compared with the copper-iron ballast, the electronic ballast as in the conventional device 2 can suppress the increase in restart voltage at a lower level even in an end stage of a life duration of the high-pressure discharge lamp. Thus, the fading-out hardly occurs, and thereby the high-pressure discharge lamp can have extended life duration.

On the other hand, the electronic ballast as in the conventional device 2 capable of suppressing the occurrence of fading-out will impose a higher load on the high-pressure discharge lamp as compared to the copper-iron ballast. The higher load is likely to deteriorate and crack an arc tube contained in the high-pressure discharge lamp. Particularly in a high-pressure discharge lamp designed to form a vacuum in an internal space of an outer tube covering an arc tube, if such cracks are produced, a luminophor in the arc tube can undesirably leak into the internal space of the outer tube. In this case, the vacuum formed in the internal space of the outer tube is spoiled, and a gas pressure therein is increased to cause the risk of occurrence of a discharge (arc discharge) between conductors having different potentials in the outer tube (this arc discharge occurring in the outer tube will hereinafter be referred to as "intra-outer-tube discharge"). If the intra-outer-tube discharge occurs, an overcurrent exceeding a rated current value will be supplied from the ballast to the high-pressure discharge lamp. In this case, the ballast has an increased temperature, and each of a base of the high-pressure discharge lamp and a socket or a cable of a lighting apparatus generates a larger quantity of heat than that in a normal state, to cause the risk of shortening of a life duration thereof. Such an intra-outer-tube discharge can also occur in the copper-iron ballast.

As measures for preventing an intra-outer-tube discharge from occurring, there has been known a technique of filling an internal space of an outer tube with an inert gas, such as nitrogen gas. However, if this technique is used, heat of an arc tube to be transferred outside will be easily transferred outside due to the inert gas filled in the outer tube. This causes a problem about lowering in temperature of the arc tube and consequent deterioration in luminous efficiency. Further, as measures for cutting off an overcurrent when it flows due to occurrence of an intra-outer-tube discharge, there has been known a technique of arranging a current fuse in a base of a high-pressure discharge lamp, and cutting off power feeding based on a meltdown of the current fuse caused by an over current.

The current fuse for use in this technique is essentially designed to avoid meltdown by a current during start-up of the high-pressure discharge lamp, because a larger current than that in a steady lighted state flows during the start-up. As a result, if an overcurrent flows due to occurrence of an intra-outer-tube discharge, it is likely that a relatively long time is required before a meltdown of the current fuse, or no meltdown is induced, depending on the overcurrent value. Therefore, it is difficult to reliably prevent a temperature rise in a ballast, a socket and others, using the current fuse. Moreover, the current fuse is likely to be oxidized due to the base heated up to high temperatures and formed as a nonconductor which precludes the lamp from maintaining a lighted state.

In view of the above conventional problems, it is an object of the present invention to provide a lighting device for a high-pressure discharge lamp, capable of preventing the occurrence of a defect in a power feed line to the high-pressure discharge lamp and the occurrence of abnormal heat generation even when an intra-outer-tube discharge occurs in the high-pressure discharge lamp, and a lighting apparatus using the lighting device.

MEANS FOR SOLVING THE PROBLEMS

In order to achieve the above object, the present invention provides a lighting device (a lighting device for a high-pressure discharge lamp) including a lighting circuit, an igniter circuit, a turn on detection circuit and first to third timers. In this lighting device, the lighting circuit controls at least one of voltage and current fed from an external power supply to the high-pressure discharge lamp (hereinafter referred to as "discharge lamp") to turn on the discharge lamp. The igniter circuit applies start-up high-voltage pulses to the discharge lamp. The turn on detection circuit detects the lump turn on. The first timer permits igniter circuit operation for a predetermined period if the discharge lamp is not turned on. The second timer activates the first timer at a predetermined intermittent time interval repetitively. The third timer counts the time elapsed for restarting the discharge lamp, and prohibits the operation of the igniter circuit after predetermined restarting time had reached.

As above, the first timer permits an operation of the igniter circuit only for a predetermined operation time during a period where the turn on detection circuit discriminates that the discharge lamp is not in the lighted state. Specifically, for example, in a state when a cable serving as a power feed line to the discharge lamp is not electrically connected to the discharge lamp, even if a discharge occurs between adjacent conductors in the cable due to the high-voltage pulses output from the igniter circuit, the turn on detection circuit discriminates that the discharge lamp is not in the lighted state. Thus, respective operations of the first and third timers are continued to intermittently apply the high-voltage pulses. That is, a continuous discharge never occurs between the conductors. This makes it possible to prevent an abnormal heat generation in the cable. Further, when an intra-outer-tube discharge occurs in the discharge lamp, the turn on detection circuit discriminates that the discharge lamp is not in the lighted state. Thus, even if an intra-outer-tube discharge occurs during the operation of the first timer, the power feeding to the discharge lamp is interrupted during the period where the second timer halts the operation of the first timer. This makes it possible to prevent continuous occurrence of the intra-outer-tube discharge so as to suppress an abnormal heat generation in the above components and a socket.

Preferably, the lighting device of the present invention further includes a fourth timer which counts a total time in which the high-voltage pulses are applied from the igniter circuit to the discharge lamp according to respective operations of the first and second timers, and a fifth timer which, in place of the second timer, activates the first timer at a predetermined intermittent time interval greater than said time interval of the second timer repetitively, after the total time counted by the fourth timer exceeds a predetermined time.

The lighting device of the present invention may further include a sixth timer which permits igniter circuit operation within the aforementioned predetermined period of the first timer, and a seventh timer which activates the sixth timer at a predetermined intermittent time interval repetitively. This makes it possible to prevent the occurrence of an intra-outer-tube discharge while ensuring a minimum start-up performance.

Preferably, in the lighting device of the present invention, the aforementioned predetermined period of the first timer and the aforementioned time interval of the second timer are set in such a manner that output voltage of the lighting circuit in a non-lighted state of the discharge lamp has an effective value less than a predetermined value.

Further, the predetermined period of the first timer and the time interval of the second timer are preferably set in such a manner as to prevent overload beyond a maximum rating of a circuit component constituting the lighting circuit, the igniter circuit, the turn on detection circuit or the first to seventh timers. This makes it possible to suppress deterioration of the circuit component so as to achieve extended life duration of the entire device. Preferably, the maximum rating of the circuit component is at least one of a temperature rating, a current rating, a voltage rating and a power rating of the circuit component.

In the lighting device of the present invention, each of the first and second timers may consist of an automatic reset-type temperature responsive switch adapted to open and close contact in response to temperature.

Preferably, in the lighting device of the present invention, the aforementioned predetermined period of the first timer just after initiation of the operation of the igniter circuit is set at a relatively large value. This makes it possible to provide an enhanced start-up performance during start-up (initial start-up) from a state after the discharge lamp is sufficiently cooled. More preferably, the predetermined period of the first timer just after initiation of the operation of the igniter circuit is set at a time sufficient for start-up of the discharge lamp.

In the lighting device of the present invention, the aforementioned predetermined period of the first timer and the aforementioned time interval of the second timer may be set in such a manner as to prevent an intra-outer-tube discharge from occurring in the discharge lamp.

In the lighting device of the present invention, the lighting circuit may consist of a copper-iron ballast. In this case, it is preferably that the igniter circuit outputs a single high-voltage pulse around a peak of an AC power supply voltage fed from the external power supply to the lighting circuit. This makes it possible to prevent the occurrence of an intra-outer-tube discharge while ensuring a minimum start-up performance.

In the lighting device of the present invention, the lighting circuit may consist of an electronic ballast. In this case, it is preferable that the lighting circuit outputs a rectangular-wave alternating current, and the igniter circuit superimposes the start-up high-voltage pulses on an output rectangular-wave voltage from the lighting circuit. This igniter circuit may be designed to generate the high-voltage pulses through the use of a resonance voltage.

Further, it is preferable that the igniter circuit superimposes a single one of the high-voltage pulses one time per one-half cycle of the output rectangular-wave voltage. This makes it possible to prevent the occurrence of an intra-outer-tube discharge while ensuring a minimum start-up performance. Furthermore, given that the one-half cycle of the output rectangular-wave voltage is divided into an initial-half stage and a last-half stage, the igniter circuit preferably superimposes the single high-voltage pulse in the initial-half stage. More preferably, the igniter circuit superimposes the single high-voltage pulse just after a polarity of the output rectangular-wave voltage is reversed.

The lighting device of the present invention may be designed such that a power is supplied from the lighting circuit to the discharge lamp through a cable which includes a plurality of electric wires each composed of a conductor having a thickness of 1 mm or less and an insulator covering the conductor, and a sheath having an insulting performance and covering the electric wires. In this case, it is preferable that the lighting circuit outputs a rectangular-wave voltage alternating at a low frequency of several ten to several hundred Hz. Further, it is preferable that the igniter circuit superimposes a high-voltage pulse of 3 to 5 kV on the rectangular-wave output voltage from the lighting circuit.

Preferably, in the lighting device of the present invention, the discharge lamp has a rated lamp power of 35 to 75 W, and the aforementioned predetermined period of the first timer and the aforementioned time interval of the second timer are set, respectively, in the range of 3 to 5 seconds and in the range of 1 to 3 seconds. More preferably, the discharge lamp has a rated lamp power of 150 W, and the aforementioned predetermined period of the first timer and the aforementioned time interval of the second timer are set, respectively, in the range of 0.5 to 1.5 seconds and in the range of 1 to 3 seconds.

The present invention further provides a lighting apparatus which includes either one of the aforementioned lighting devices. This lighting apparatus comprises a case for housing the lighting circuit and the igniter circuit, a socket adapted to mechanically connected to a base of the discharge lamp, a lamp fitting including a reflector for reflecting light to be emitted from the discharge lamp, and a cable including a plurality of electric wires each covered by an insulator and a sheath having an insulting performance and covering the electric wires. In this lighting apparatus, the lighting circuit and the igniter circuit are electrically connected to the socket through the cable. This lighting apparatus has the same functions as those of either one of the aforementioned lighting devices, and can suppress a heat generation in the cable and the socket.

ADVANTAGES OF THE INVENTION

As mentioned above, the present invention can provide a lighting device and a lighting apparatus, capable of preventing the occurrence of a defect in a power feed line to a discharge lamp and the occurrence of abnormal heat generation even when an intra-outer-tube discharge occurs in the discharge lamp.

BRIEF DESCRIPTION OF DRAWINGS

FIG. 25 is a circuit diagram showing the configuration of a conventional lighting device (conventional device 2).

EXPLANATION OF CODES

Figure 1:
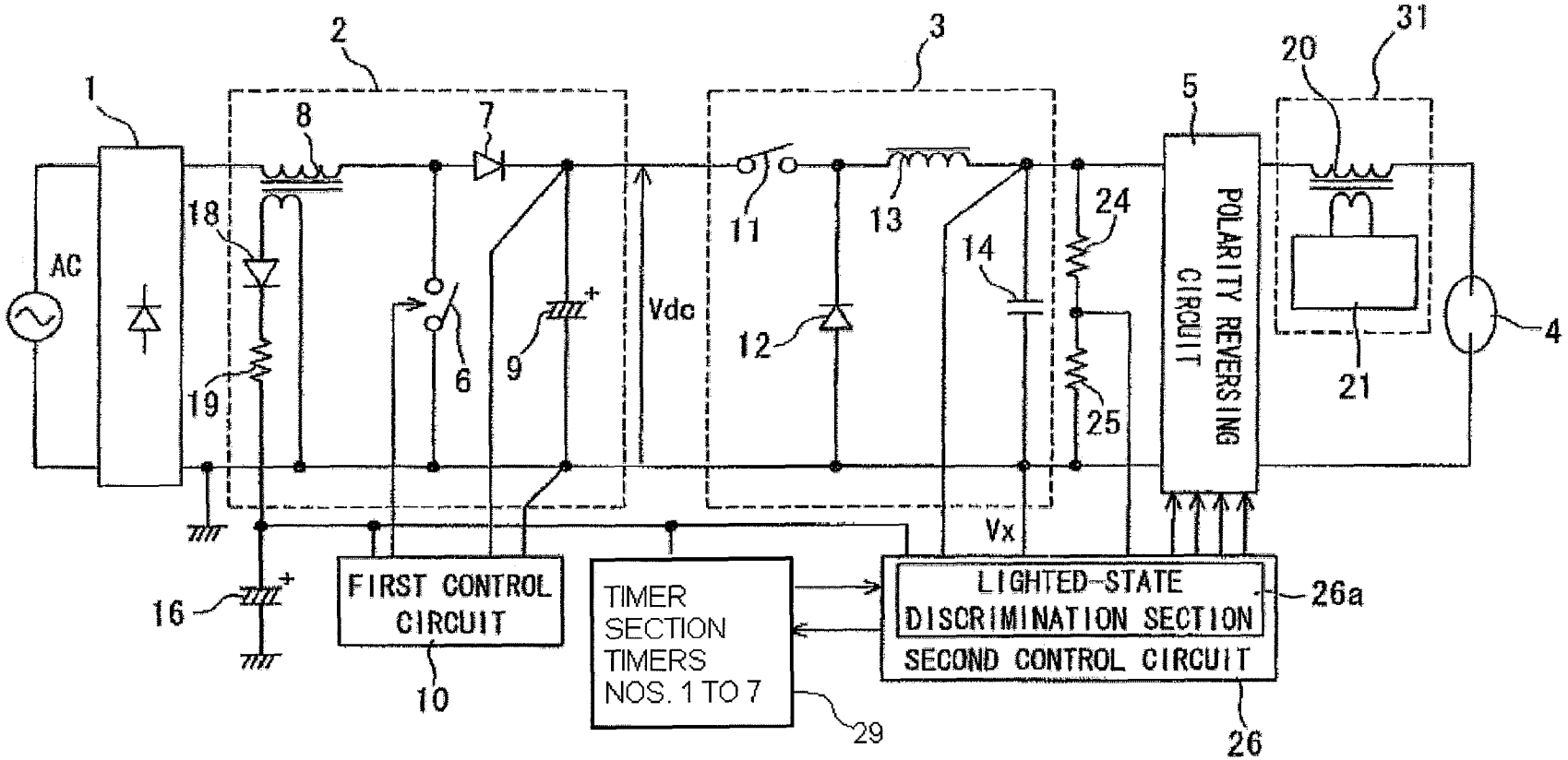
FIG. 1 is a circuit block diagram showing the configuration of a lighting device according to a first embodiment of the present invention.

1: rectification circuit
2: step-up chopper circuit
3: step-down chopper circuit
4: high-pressure discharge lamp (discharge lamp)
5: polarity reversing circuit
6: switching element
7: rectifying element
8: chopper choke
9: smoothing capacitor
10: first control circuit
11: switching element
12: rectifying element
13: chopper choke
14: smoothing capacitor
15: second control circuit
16: capacitor
18: diode
19: resistor
20: pulse transformer
21: pulse generator
24: voltage-dividing resistor
26: second control circuit
26*a*: turn on detection circuit
29: timer
31: igniter circuit

BEST MODE FOR CARRYING OUT THE INVENTION

This application is based upon and claims the benefit of priority from Japanese Patent Application No. 2003-415373 filed in the Japanese Patent Office, the entire contents of which are incorporated herein by reference. With reference to the accompanying drawings, an embodiment of the present invention will now be specifically described. In the accompanying drawings, the common element or component is defined by the same reference numeral.

First Embodiment

As shown in FIG. 1, a lighting device (electronic ballast) for a discharge lamp (high-pressure discharge lamp), according to a first embodiment of the present invention, has the same fundamental configuration as that of the conventional device 2 illustrated in FIG. 25. Specifically, the lighting device according to the first embodiment includes a rectification circuit 1 for full-wave rectifying a voltage from an AC power supply AC which is a commercial power supply, a step-up chopper circuit 2 for converting a pulsating voltage rectified through the rectification circuit 1 into a desired DC voltage, a step-down chopper circuit 3 for stepping down an output DC voltage from the step-up chopper circuit 2, a polarity reversing circuit 5 for alternating an output DC voltage from the step-down chopper circuit 3 at a low frequency of several ten to several hundred Hz to apply a rectangular-wave voltage to a discharge lamp 4 (high-pressure discharge lamp), and an igniter circuit 31 for applying start-up high-voltage pulses to the discharge lamp 4. In view of avoiding redundant descriptions, descriptions about the common components with those of the conventional device 2 will be omitted.

Figure 2:
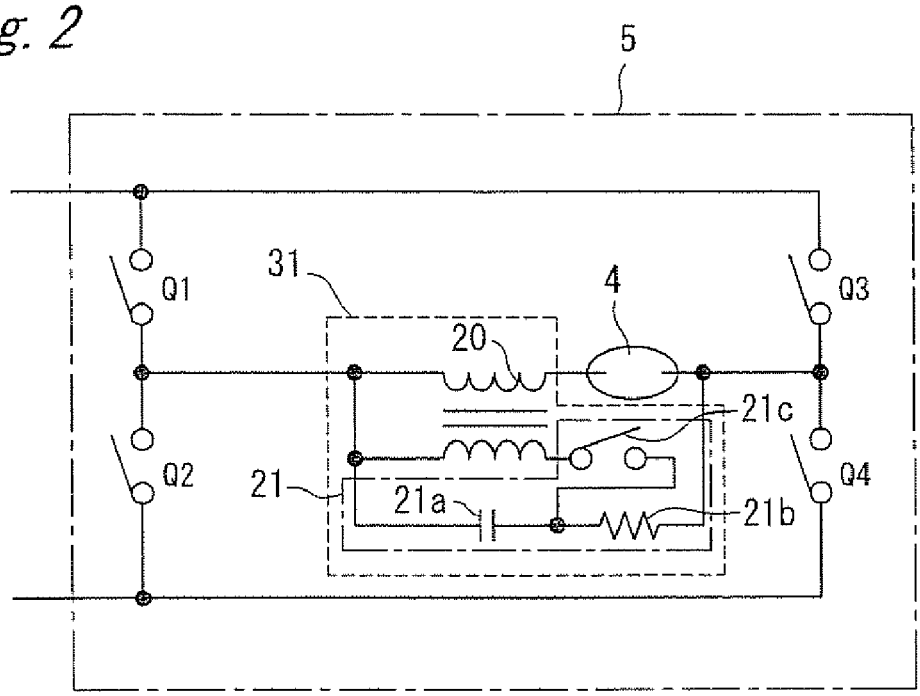
FIG. 2 is a circuit diagram of a polarity reversing circuit and an igniter circuit constituting the lighting device according to the first embodiment.

FIG. 2 shows a specific circuit configuration of the polarity reversing circuit 5 and the igniter circuit 31 constituting the lighting device illustrated in FIG. 1. The polarity reversing circuit 5 is comprised of a bridged circuit including four switching elements Q1, Q2, Q3, Q4, The two switching elements Q1 Q2 connected in series with one another and the two switching elements Q3, Q4 connected in series with one another are connected, respectively, in parallel between both output ends of the step-down chopper circuit 3. The discharge lamp 4 is connected between a connection point of the switching element Q1 and the switching element Q2 and a connection point of the switching element Q3 and the switching element Q4, through the igniter circuit 31. The polarity reversing circuit 5 is operable to alternately turn on the two non-adjacent switching elements Q1, Q4, and the two non-adjacent switching elements Q2, Q3 so as to alternate an output DC voltage from the step-down chopper circuit 3 at a low frequency of several ten to several hundred Hz, and apply an obtained rectangular-wave voltage to the discharge lamp 4.

The igniter circuit 31 comprises a pulse transformer 20 having a secondary winding inserted between the polarity reversing circuit 5 and the discharge lamp 4, a capacitor 21*a* and a resistor 21*b* each connected in parallel to the discharge lamp 4 and the secondary winding of the pulse transformer 20, and voltage responsive element 21*c*, such as SIDAC, connected in series to a primary winding of the pulse transformer 20 and connected in parallel to the capacitor 21*a*. The capacitor 21*a* is charged by the output rectangular-wave voltage from the polarity reversing circuit 5. In the polarity reversing circuit 5, when a voltage between both ends of the capacitor 21*a* exceeds a breakover voltage of the voltage responsive element 21*c*, the voltage responsive element 21*c* is turned on. Consequently, charges accumulated in the capacitor 21*a* are discharged through the voltage responsive element 21*c* and the primary winding of the pulse transformer 20. Thus, a stepped-up high-voltage pulse is generated in the secondary winding of the pulse transformer 20.

A first control circuit 10 is composed using a general-purpose active filter IC [e.g. SC33262DR2 (available from Motorola Inc.)], and designed to PWM-control the switching element 6 of the step-up chopper circuit 2. A second control circuit 26 is composed using an analog IC, and designed to PWM-control the switching element 11 of the step-down chopper circuit 3 and on/off-control the four switching elements Q1, Q2, Q3, Q4 of the polarity reversing circuit 5. The second control circuit 26 is provided with a turn on detection circuit 26*a*. The turn on detection circuit 26*a* is operable to compare a detection voltage vx obtained by dividing an DC output voltage of the step-down chopper circuit 3 equivalent to a lamp voltage of the discharge lamp 4 by voltage-dividing resistors 24, 25, with a given threshold value. Then, the turn on detection circuit 26*a* is operable, when the detection voltage Vx is equal to or less than the threshold value, to determine that the discharge lamp 4 is in its lighted state, and turn on a discrimination signal. Further, the turn on detection circuit 26*a* is operable, when the detection voltage Vx is greater than the threshold value, to determine that the discharge lamp 4 is not in the lighted state, i.e. the discharge lamp 4 is in its non-lighted state or in a no-load state, and turn off the discrimination signal.

The discrimination signal of the turn on detection circuit 26*a* is input to a timer 29. The timer 29 is designed to be triggered when the discrimination signal is changed from its ON state to its OFF state so as to start operating, and stop operating when the discrimination signal is changed from the OFF state to the ON state. The second control circuit 26 may be composed using a general-purpose switching-regulator control IC [e.g. μPC494 (available from NEC Co.)], and the turn on detection circuit 26*a* may be composed using a comparator IC.

The timer 29 is composed using, for example, an 8-bit microcomputer [e.g. MP47C102M (available from Toshiba Co)]. The timer 29 is operable to count a given time duration (hereinafter referred to as "operation-enabling time") T1 in which an operation of the igniter circuit 31 is enabled, a time interval (hereinafter referred to as "interval time") T2 at which the operation-enabling time T1 is repeatedly counted, and a sufficient time duration (hereinafter referred to as "restart time") T3 for restart of the discharge lamp 4.

Figure 3:
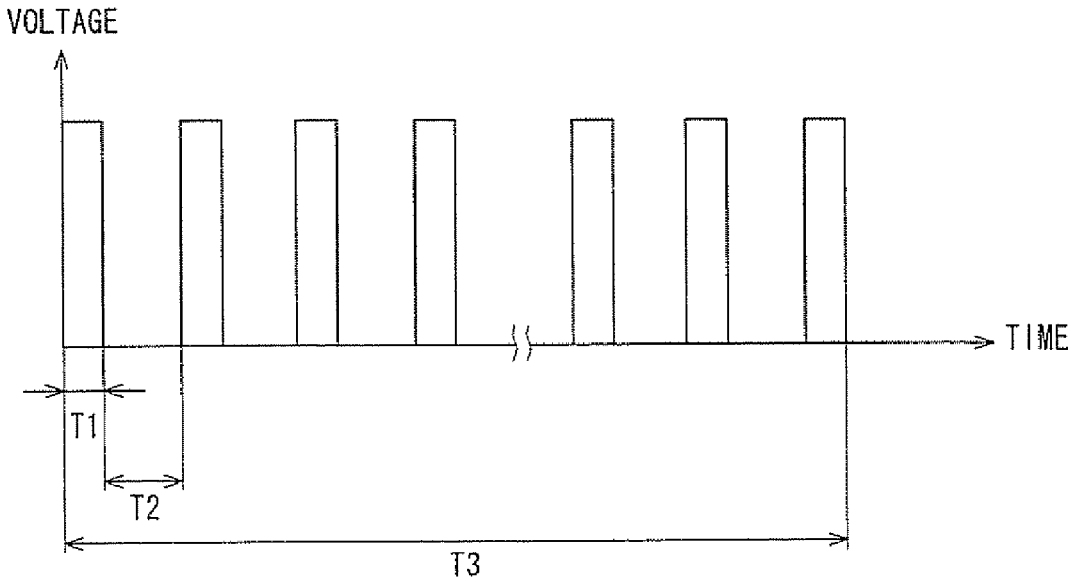
FIG. 3 is a chart showing an operation of a timer in the lighting device according to the first embodiment.

As shown in FIG. 3, the timer 29 repeatedly outputs a rectangular pulse having a pulse width of the operation-enabling time T1, with the interval time T2 between the adjacent rectangular pulses, and stops outputting the rectangular pulse when the restart time T3 has elapsed since initiation of the output of the rectangular pulse. Instead of using a microcomputer, the timer 29 may be composed of a combination of general-purpose ICs [e.g. μPC155 (available from NEC Co.) and AN6780 (available from Matsushita Electric Industrial Co., Ltd.)].

In response to turn on of an AC power supply AC, the first control circuit 10 starts operating to activate the step-up chopper circuit 2. Simultaneously, the second control circuit 26 starts operating to activate the step-down chopper circuit 3. At this moment, the discharge lamp 4 is in the non-lighted state, and thereby the DC output voltage of the step-down chopper circuit 3 becomes fairly higher (about 300 V) than that when the discharge lamp 4 is in the lighted state. Thus, the detection voltage Vx exceeds the threshold value, and the discrimination signal to be output from the turn on detection circuit 26*a* to the timer 29 is turned off so as to allow the timer to be triggered. Consequently, the rectangular pluses as shown in FIG. 3 are output from the timer 29 to the control circuit 26.

The second control circuit 26 operates to activate the step-down chopper circuit 3 and the polarity reversing circuit 5 during an ON duration of the rectangular pulse or during the operation-enabling time T1 so as to allow the igniter circuit 31 to output a high-voltage pulse of 3 to 5 kV therefrom. The control circuit 26 also operates to deactivate the step-down chopper circuit 3 and the polarity reversing circuit 5 during an OFF duration of the rectangular pulse or during the interval time T2 so as to preclude the igniter circuit 31 from outputting the high-voltage pulse therefrom.

Figure 4:
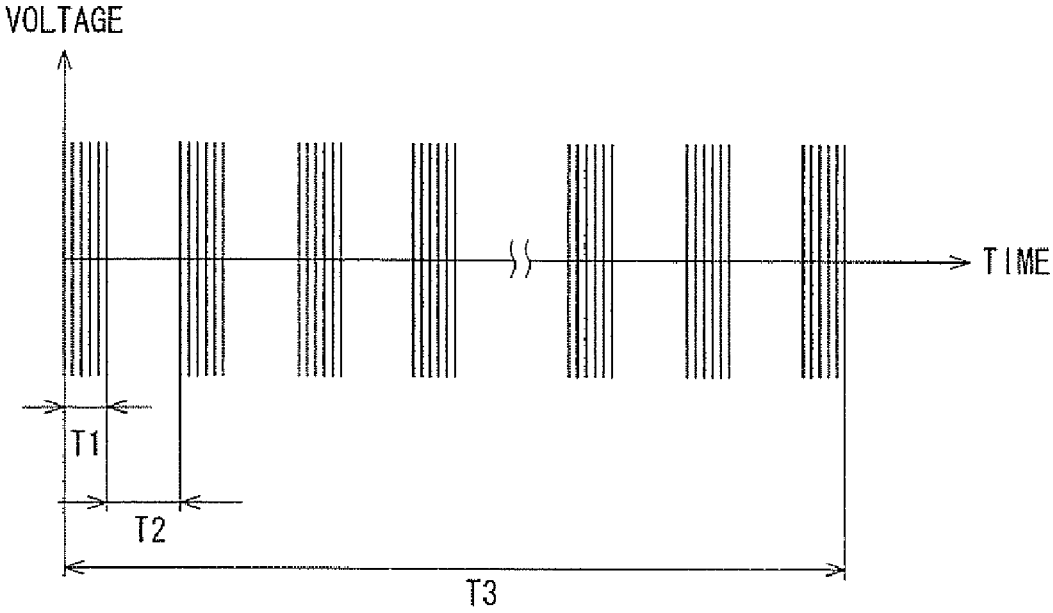
FIG. 4 is a chart showing an operation of the igniter circuit in the lighting device according to the first embodiment.
Figure 5:
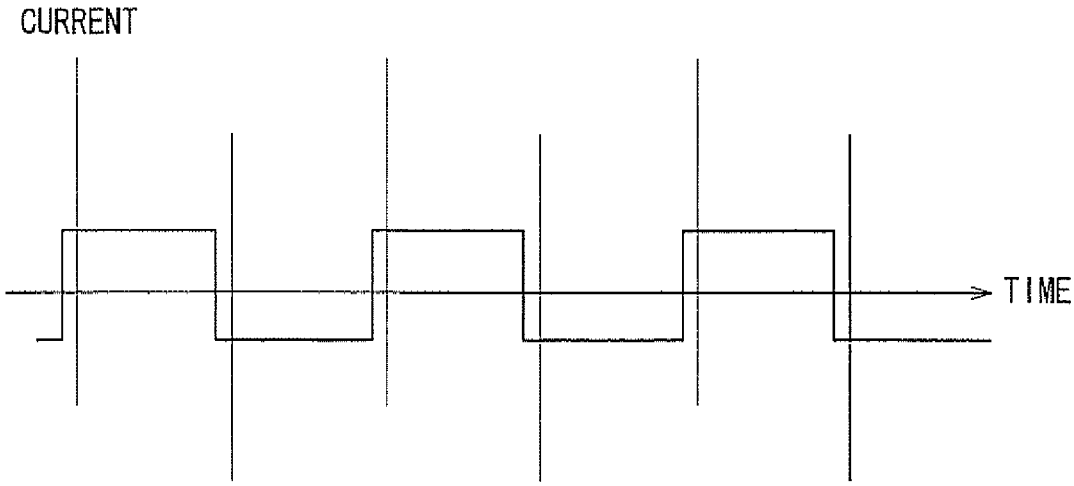
FIG. 5 is a chart showing an operation of the lighting device according to the first embodiment.

In the above manner, the igniter circuit 31 operates only for each of the operation-enabling times T1 with the interval time T2 between the adjacent operation-enabling times T1, as shown in FIGS. 4 and 5. Thus, the high-voltage pulses superimposed on the rectangular-wave voltage are applied to the discharge lamp 4. FIG. 5 is a waveform chart showing the high-voltage pulses superimposed on the rectangular-wave voltage in the respective operation-enabling times T1.

The timer 29 starts counting the restart time T3 simultaneously with initiation of the counting of the operation-enabling time T1. Then, if the discrimination signal to be output from the turn on detection circuit 26*a* in response to start-up of the discharge lamp 4 is not turned within the period of the restart time T3, for example, if the discharge lamp 4 does not start up because it is in the last phase of its life duration or the discharge lamp 4 is not attached to a socket (no-load state), the output of the rectangular pulse is stopped. Consequently, the second control circuit 26 operates to deactivate the step-down chopper circuit 3 and the polarity reversing circuit 5. Thus, the output of the high-voltage pulses from the igniter circuit 31 is also stopped.

When the discharge lamp 4 starts up before elapse of the restart time T3, the DC output voltage of the step-down chopper circuit 3 is reduced to a rated lamp voltage (90 to 100 V) of the discharge lamp 4. Thus, the detection voltage Vx becomes less than the threshold value, and thereby the discrimination signal to be output from the turn on detection circuit 26*a* to the timer 29 is changed from the OFF state to the ON state to stop the operation of the timer 29. Further, when the discharge lamp 4 fades out, the discrimination signal to be output from the turn on detection circuit 26*a* to the timer 29 is changed from the ON state to the OFF state to allow the timer 29 to be triggered so as to perform the above operations.

Figure 6:
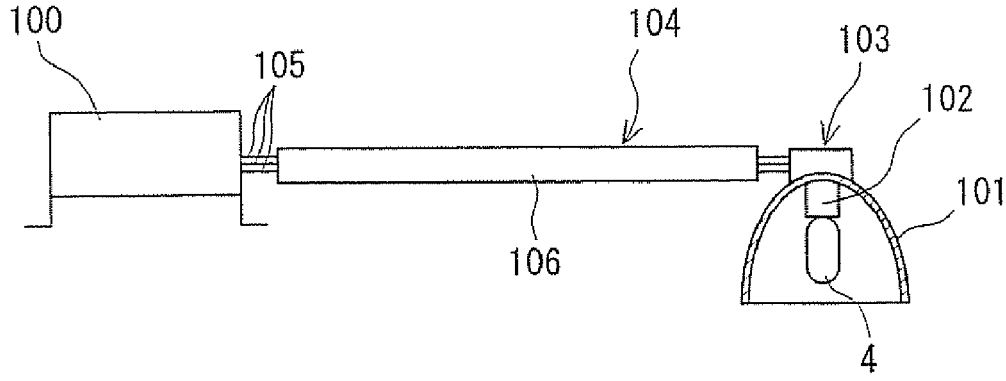
FIG. 6 is a partly broken-out top plan view showing a lighting apparatus equipped with the lighting device according to the first embodiment.

For example, as shown in FIG. 6, a lighting apparatus using the lighting device according to the first embodiment comprises a case 100 housing the lighting device, a lamp fitting 103 including a semispherical-shaped reflector 101 and a socket 102, and a cable 104 arranged between the case 100 and the lamp fitting 103 to serve as a power feed line from the lighting device to the discharge lamp 4.

Figure 7A:
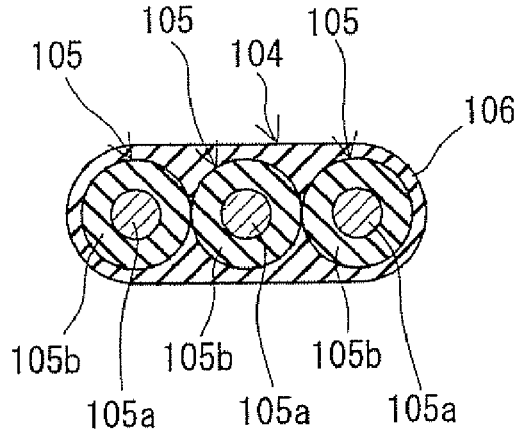
FIG. 7A is a sectional view showing a three-core cable for used in the lighting apparatus according to the first embodiment.
Figure 7B:
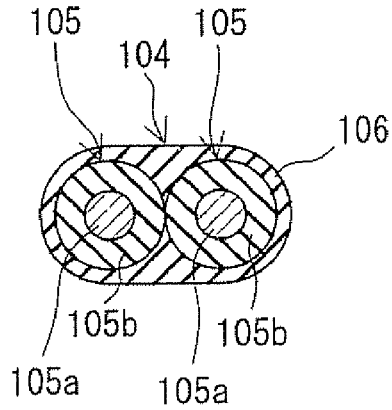
FIG. 7B is a sectional view showing a two-core cable for used in the lighting apparatus according to the first embodiment.

As shown in FIGS. 7A and 7B, the cable 104 is a flat cable (e.g. VVF cable) comprising two to three electric wires 105 and a sheath 106 having an insulating performance. Each of the electric wires 105 includes a conductor 105*a* having a circular shape in section and an insulator 105*b* covering the conductor 105*a*. Generally, when the cable 104 is used in this type of lighting apparatus, the conductor 105*a* has a diameter of 1.6 to 2.0 mm in most cases. Further, the insulator 105*a* has a thickness of about 0.8 mm Thus, if the cable 104 is scratched or damaged, or a connection between the lamp fitting 103 and the cable 104 is defective (e.g. neglect of the connection), the high-voltage pulses output from the igniter circuit 31 at 3 to 5 kV are applied to the adjacent insulators 105*a* having a total thickness of about 1.6 mm. This is likely to cause dielectric breakdown in the insulator 105*a* and a discharge between the adjacent conductors 105*a*. Then, due to the discharge between the adjacent conductors 105*a*, the DC output voltage from the step-down chopper circuit 3 is lowered from the voltage (about 300 V) in the non-lighted state or no-load state. In this case, the threshold in the turn on detection circuit 26*a* can be set at an adequate value to prevent such a discharge from being erroneously discriminated to be a discharge in the discharge lamp 4. Thus, the operation of the timer 29 can be continued to intermittently apply the high-voltage pulses to avoid the occurrence of a continuous discharge between the conductors 105*a* so as to prevent an abnormal heat generation in the cable 105.

Through experimental tests, the inventors had the following knowledge: Under the following conditions, the threshold value can be set at a value equivalent to the detection voltage Vx obtained when the DC output voltage of the step-down chopper circuit 3 is 160 V, to prevent the turn on detection circuit 26*a* erroneously discriminating a discharge between the conductors 105*a* as the lighted state.

(Conditions)

(1) The high-voltage pulse has a peak value of 5 kv;

(2) The pulse width at 300 V is about 2.5 microseconds;

(3) The load is a metal halide lamp having a rated lamp power of 150 W when the DC output voltage from the step-down chopper circuit 3 is about 300 V Under the same conditions, the high-voltage pulses were applied to the discharge lamp 4 (the above metal halide lamp), and a time (start-up time) required for transition from a glow discharge to an arc discharge was measured As a result, it was found that the start-up time during start-up (initial start-up) from a state after a gas pressure in an arc tube of the discharge lamp 4 is sufficiently lowered is about 0.5 sec. This shows that the operation-enabling time T1 of the timer 29 and the interval time T2 can be set, respectively, at about 1 second and about 2 seconds, to suppress a heat generation due to a discharge between the conductors 105*a* of the cable 104 occurring when the AC power supply AC is turned on under the condition that the cable 104 is not connected to the lamp fitting 103.

Further, when an intra-outer-tube discharge occurs in the discharge lamp 4, the turn on detection circuit 26*a* never erroneously discriminates this state as the lighted state. Thus, even through an intra-outer-tube discharge occurs during the operation-enabling time T1, the power feeding to the discharge lamp 4 is interrupted during the interval time T2 to prevent the intra-outer-tube discharge from continuously occurring. This makes it possible to suppress an abnormal heat generation in the above components and the socket 102.

Generally, an arc tube of a discharge lamp (high-pressure discharge lamp) has a relatively high gas pressure during restart. This makes it hard for the discharge lamp to start up. For example, a metal halide lamp typically requires three minutes or more before a gas pressure in an arc tube thereof is lowered to a restartable value since turn-off of the lamp. Moreover, during restart, dielectric breakdown arising in the discharge lamp after being set in a glow discharge state causes difficulty in making the transition to an arc discharge state in some cases. In this case, if the high-voltage pulses are applied using the short interval time T2, the discharge lamp will be warmed up, and the start-up of the discharge lamp becomes harder. Thus, it is desirable to apply the pulsed high pressure after the discharge lamp is sufficiently cooled.

Figure 8:
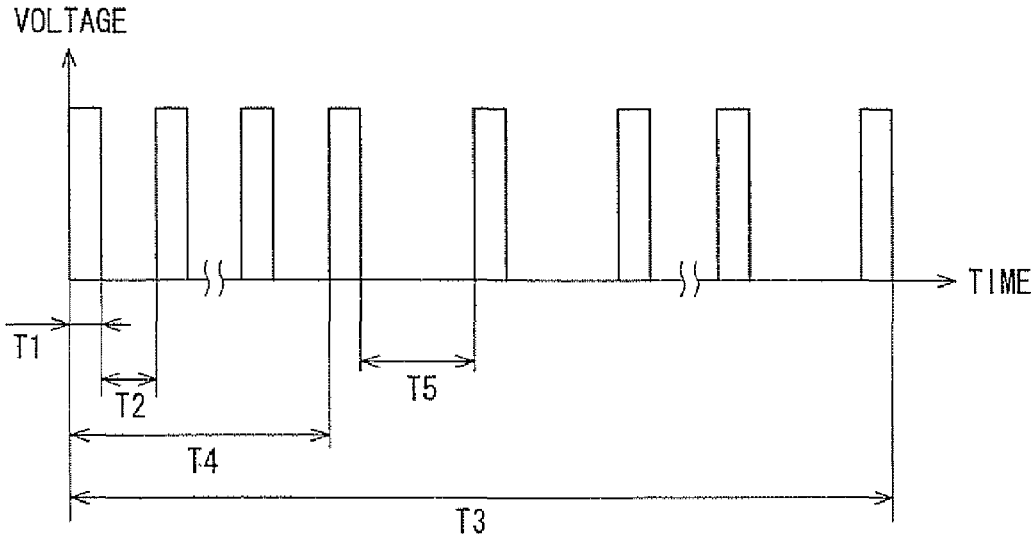
FIG. 8 is a chart showing another operation of the timer in the lighting device according to the first embodiment.
Figure 9:
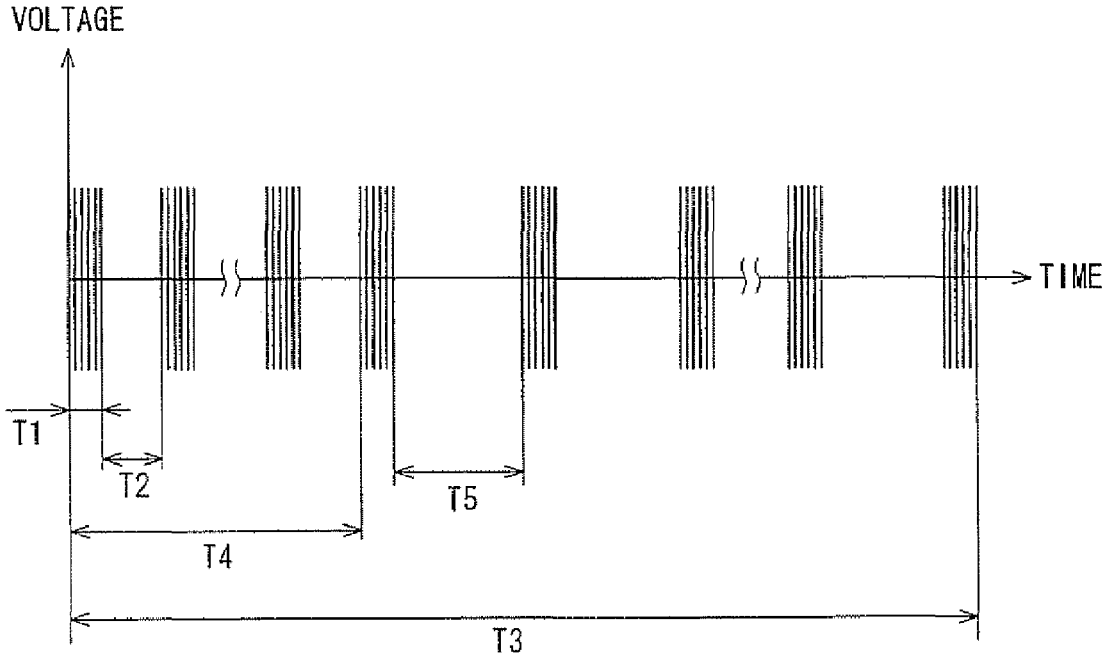
FIG. 9 is a chart showing another operation of the igniter circuit in the lighting device according to the first embodiment.

Form this standpoint, the timer 28 may operate as shown in FIGS. 8 and 9. Specifically, the timer 28 operated to count a total time T4 in which the high-voltage pulses are applied from the igniter circuit 31 to the discharge lamp 4 based on repetition of the operation-enabling time T1 and the interval time T2. Then, when the total time T4 is counted during initial start-up, the operation-enabling time T1 is intermittently repeated using an interval time T5 (>T2) greater than the interval time T2, after a given time (<T3) deemed to be sufficient for start-up has elapsed. This makes it possible to apply the high-voltage pulses after the discharge lamp 4 is sufficiently cooled so as to reduce a time required for restart and suppress deterioration of the cable 104.

The inventors prepared three metal halide lamps (MT70E-LW/PG available from Matsushita Electric Industrial Co., Ltd.) having a rated lamp power of 70 W, and respective times required for restart in the following two cases were experimentally compared with each other.

(1) First Case operation-enabling time T1: about 5 seconds

Initial interval time T2: about 2 seconds

Total time T4: about 28 seconds

Last interval time T5: about 25 seconds (2) Second Case operation-enabling time T1: about 5 seconds Interval time T2: about 2 seconds As a result, in the first case, each of the three metal halide lamps required about 3 minutes for restart. In the second case, the worst one of the three metal halide lamps required 11 minutes or more for restart. The reason for setting the operation-enabling time T1 at about 5 seconds is as follows: Generally, as compared with a metal halide lamp having a rated lamp power of 35 W or 150 W, the metal halide lamp having a rated lamp power of 70 W requires a longer time for making the transition from a glow discharge to an arc discharge. Thus, it is necessary to start up the lamp within the first operation-enabling time T1 during initial start-up wherever possible. Further, a time required for restart varies depending on individual difference between the discharge lamps 4 and surroundings. Thus, a slightly longer time for restart will not come to an issue in most cases.

Figure 12:
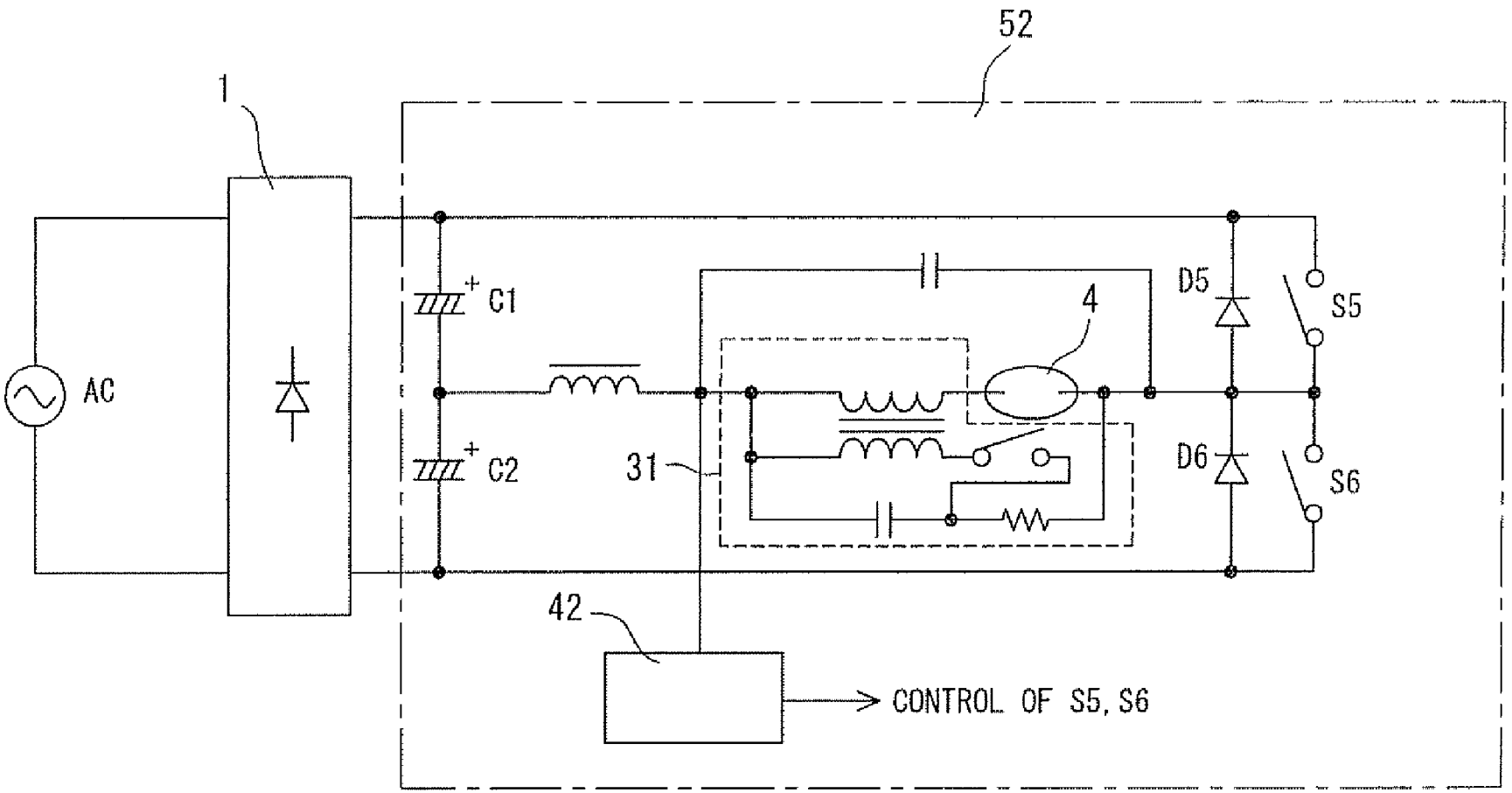
FIG. 12 is a circuit block diagram showing the configuration of a lighting device as another example of modification of the lighting device according to the first embodiment.

The lighting device according to the first embodiment is designed to supply the low-frequency rectangular-wave voltage/current to the discharge lamp 4 through the use of the step-down chopper circuit 3 and the polarity reversing circuit 5. Alternatively, a full-bridge type inverter circuit 43 as shown in FIG. 10 or a half-bridge type inverter circuit 52 as shown in FIG. 12 may be used.

Figure 10:
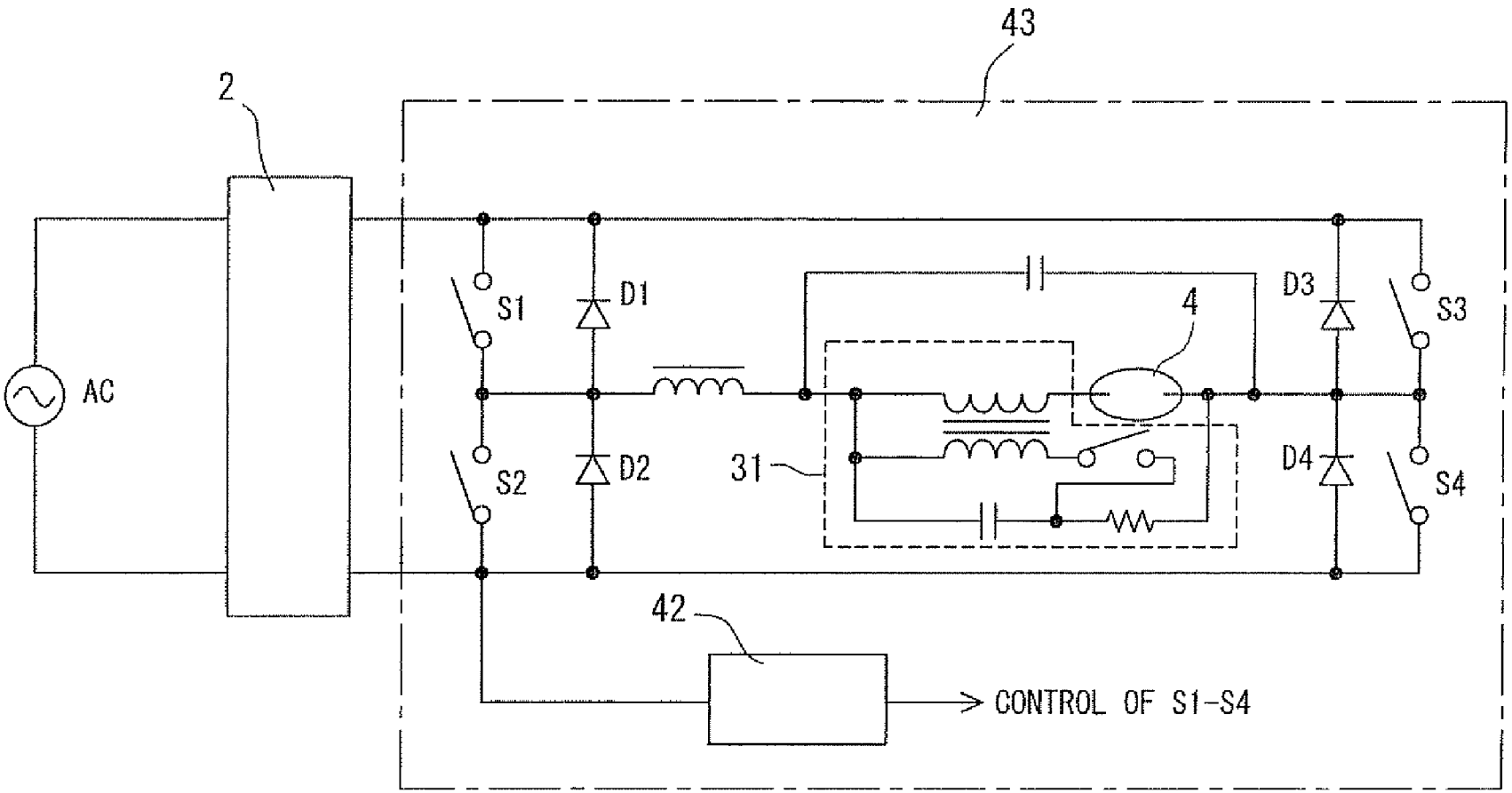
FIG. 10 is a circuit block diagram showing the configuration of a lighting device as one example of modification of the lighting device according to the first embodiment.

In the full-bridge type inverter circuit 43 illustrated in FIG. 10, a bridged circuit including four switching elements S1, S2, S3, S4 and four diodes D1, D2, D3, D4 is connected between both output ends of a step-up chopper circuit 2.

Specifically, the two switching elements S1, S2 connected in series with one another, the two diodes D1, D2 connected in series with one another, the two diodes D3, D4 connected in series with one another, and the two switching elements S3, S4 connected in series with one another, are connected, respectively, in parallel between both output ends of the step-up chopper circuit 2. In this bridged circuit, the diodes D1, D2 and the diodes D3, D4 are connected to a DC output voltage of the step-up chopper circuit 2 in opposite directions (in an antiparallel manner or back-to-back connection). Further, an igniter circuit 31 and a load circuit including a discharge lamp 4 are connected between a connection point of the switching element S1 and the switching element S2 or a connection point of the diode D1 and the diode D2, and a connection point of the switching element S3 and the switching element S4 or a connection point of the diode D3 and the diode D4.

Figure 11:
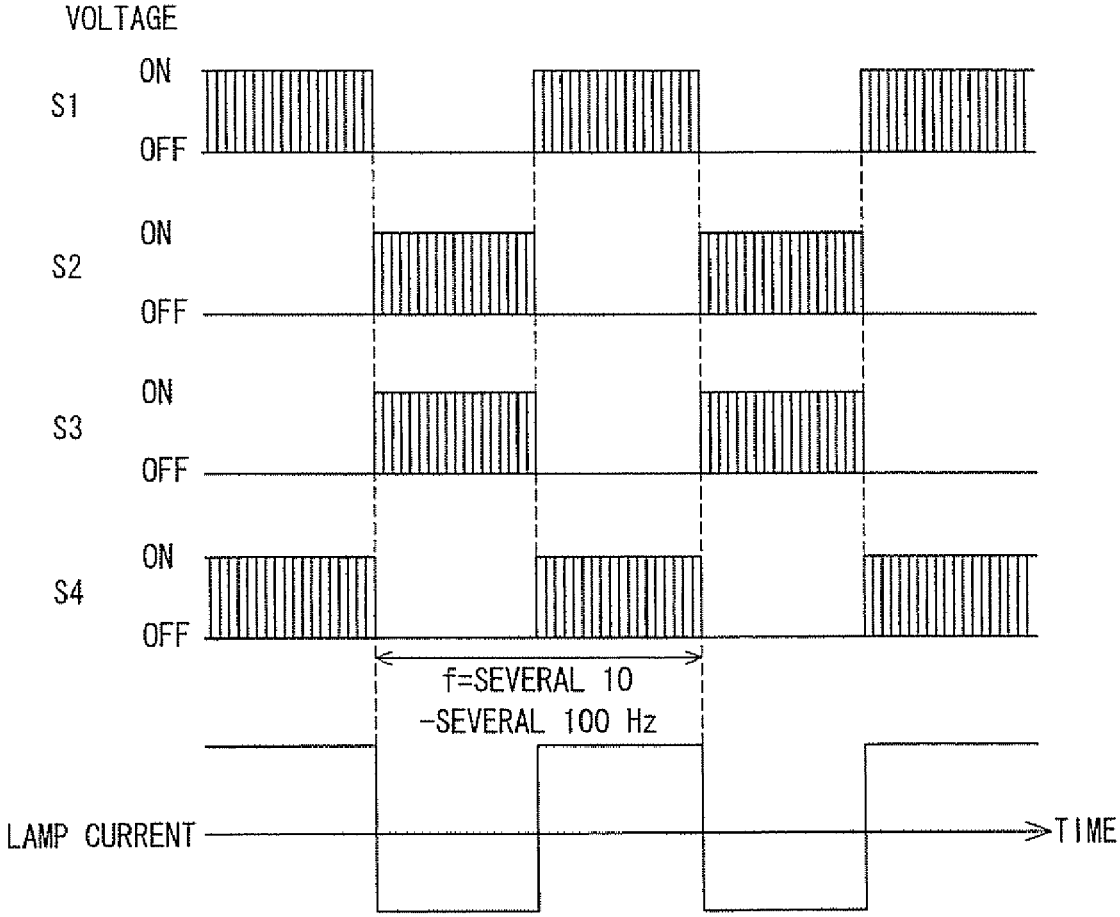
FIG. 11 is a chart showing an operation of the lighting device illustrated in FIG. 10.

A control circuit 42 is operable to on/off-control the switching elements S1, S2, S3, S4. As shown in FIG. 11, the control circuit 42 is designed to alternately repeat at a low frequency (several ten to several hundred Hz) a first period for turning on/off the two non-adjacent switching elements S1, S4 at a high frequency, and a second period for turning on/off the two non-adjacent switching elements S2, S3 at a high frequency, and a second period, so as to supply a rectangular-wave lamp current to the discharge lamp 4.

In the half-bridge type inverter circuit 52 illustrated in FIG. 12, two smoothing capacitors C1, C2 connected in series with one another, the two diodes D5, D6 connected in series with one another, and the two switching elements S5, S6 connected in series with one another, are connected, respectively, in parallel between both output ends of a rectification circuit 1. The diodes D5, D6 are connected to a DC output voltage of the rectification circuit 1 in opposite directions (in an antiparallel manner or back-to-back connection). Further, an igniter circuit 31 and a load circuit including a discharge lamp 4 are connected between a connection point of the smoothing capacitor C1 and the smoothing capacitor C2, and a connection point of the switching element S5 and the switching element S6 or a connection point of the diode D5 and the diode D6.

Figure 13:
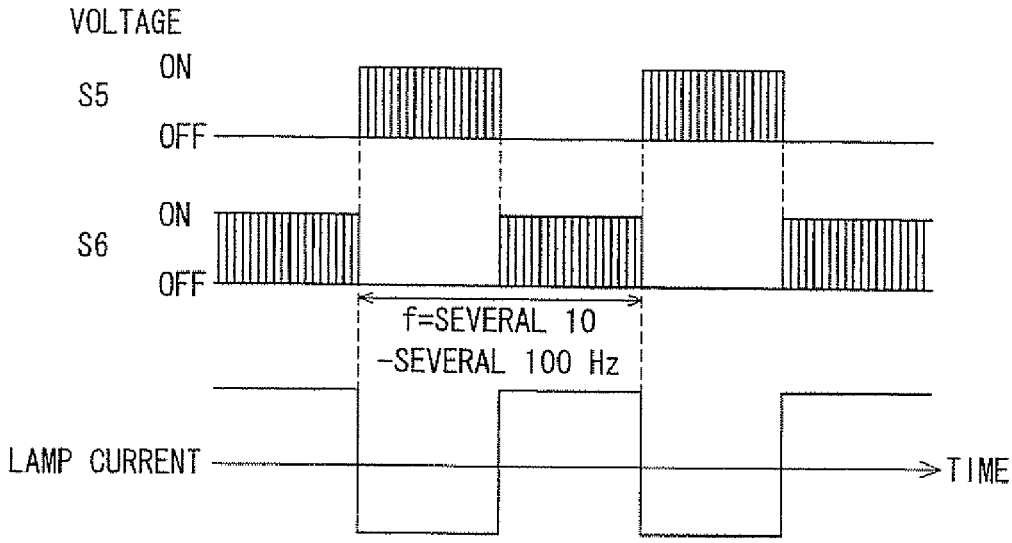
FIG. 13 is a chart showing an operation of the lighting device illustrated in FIG. 10.

A control circuit 42 is operable to on/off-control the switching elements S5, S6. As shown in FIG. 13, the control circuit 42 is designed to alternately repeat at a low frequency (several ten to several hundred Hz) a first period for turning on/off one S5 of the switching elements at a high frequency, and a second period for turning on/off the other switching element S6 at a high frequency, and a second period, so as to supply a rectangular-wave lamp current to the discharge lamp 4.

Further, a turn on detection circuit (not shown) is operable to discriminate whether or not the discharge lamp 4 is in its lighted state. Furthermore, a timer (not shown) is used for repeatedly activating the igniter circuit 31 for an operation-enabling time T1 with an interval time T2 between the adjacent operation-enabling times T1, only when the turn on detection circuit discriminates that the discharge lamp 4 is not in the lighted state. This makes it possible to suppress an abnormal heat generation in a cable 104 and others.

A ballast for a high-pressure discharge lamp having a rated output power of greater than 300 V is obliged to be an insulated type, or have an interlock function (i.e. function of automatically cutting off an output when the discharge lamp is detached therefrom) (see Appendix VI, "Guide for Technical Standards of Electrical Appliance and Material"). Thus, in the lighting device according to the first embodiment, it is desirable to set the operation-enabling time T1 and the interval time T2 in such a manner as to allow an output voltage in the non-lighted state of the discharge lamp 4 to have an effective value of less than 300 V.

Figure 14A:
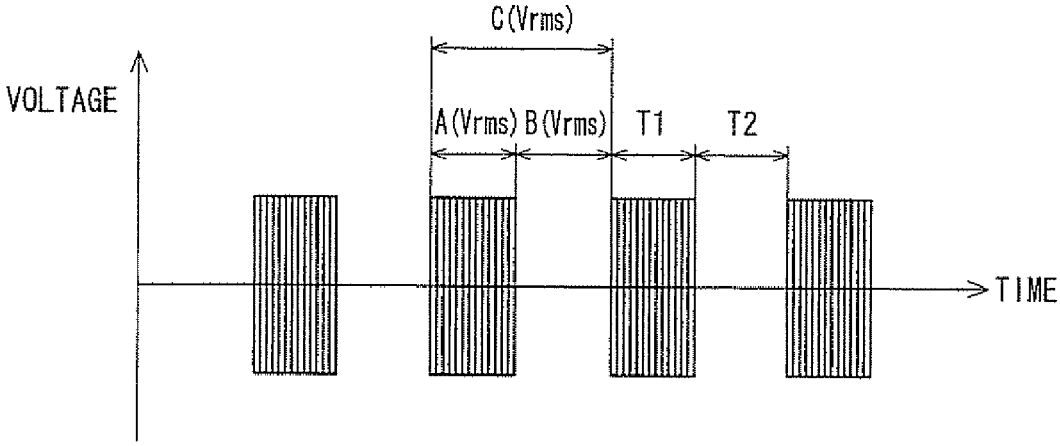
FIG. 14A is a chart showing yet another operation of the igniter circuit in the lighting device according to the first embodiment.
Figure 14B:
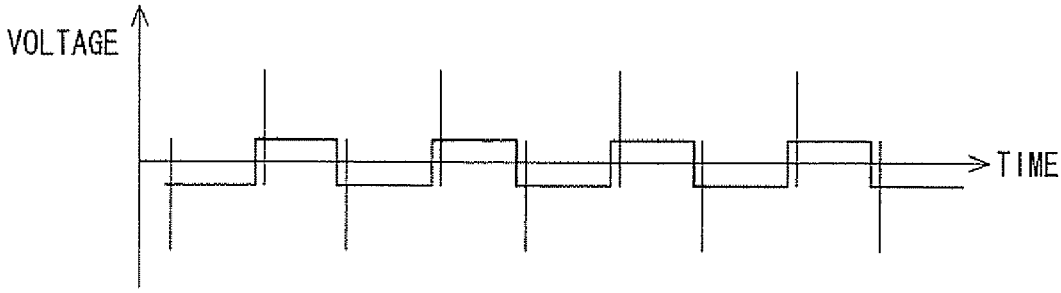
FIG. 14B is a chart showing an operation of a lighting device as yet another example of modification of the lighting device according to the first embodiment.

Specifically, as shown in FIGS. 14A and 14B, an effective value C (Vrms) of an output voltage is expressed as an average value of an effective value A (Vrms) of the output voltage with the superimposed high-voltage pulses in the operation-enabling times T1 and an effective value B (Vrms) of the output voltage in the interval times T2. Thus, even when the effective value A (Vrms) of the output voltage in the operation-enabling times T1 is greater than 300 V, the operation-enabling time T1 and the interval time T2 can be adequately set to limit the effective value C (Vrms) of the output voltage to a value less than 300 V. FIG. 14B is a waveform chart showing a rectangular-wave voltage having the high-voltage pulses superimposed thereon in the operation-enabling times T1.

Second Embodiment

A second embodiment of the present invention will be specifically described below. A feature of a lighting device according to the second embodiment (or a lighting apparatus equipped with the lighting device according to the second embodiment) is in that the operation-enabling time T1 and the interval time T2 are set in such a manner as to prevent overload beyond a maximum rating of a circuit component a circuit component constituting each section, in the non-lighted state of the discharge lamp 4. The lighting device according ton the second embodiment has a circuit configuration and operation in common with those in the first embodiment, and descriptions about the common parts will be omitted. Further, the following description will be made with reference to the figures relating to the first embodiment where necessary.

Figure 15:
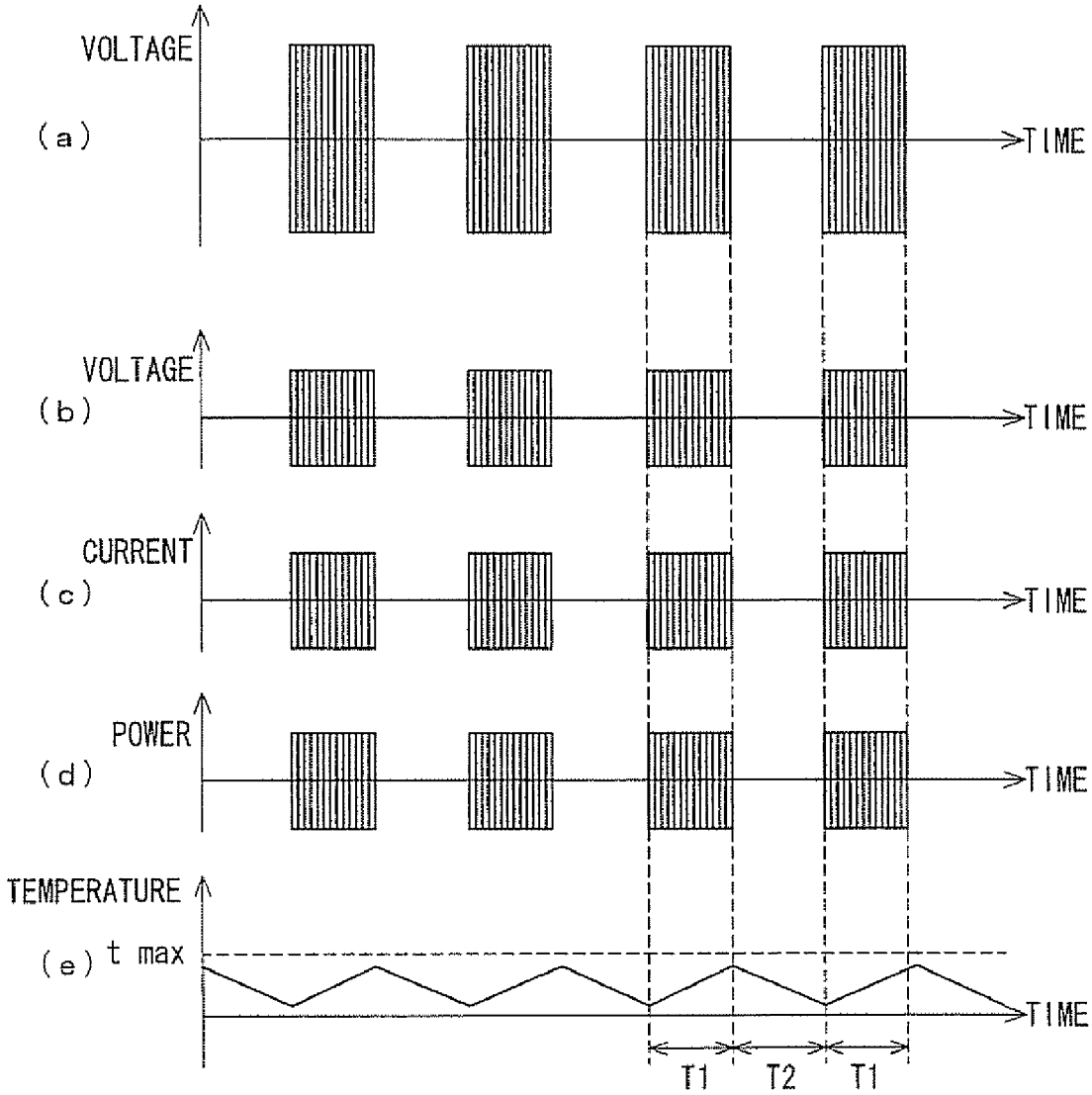
FIG. 15 is a chart showing an operation of a lighting device according to a second embodiment of the present invention.

In the second embodiment, the lighting device is configured with a focus, for example, on the resistor 21*b* which is a component (circuit component) of the igniter circuit 31. Specifically, as shown in the graphs (b), (c) and (d), the operation-enabling time T1 and the interval time T2 are adequately set in such a manner as to prevent that each of a voltage between both ends of the resistor 21*b*, a current flowing the resistor 21*b* and an effective value of a power consumed by the resistor 21*b*, from exceeding a maximum rating of the resistor 21*b*, when the rectangular-wave voltage with the superimposed high-voltage pulses is applied to the discharge lamp 4 as shown in the graph (a) of FIG. 15. Further, the operation-enabling time T1 and the interval time T2 are preferably set in such a manner as to prevent a temperature of the resistor 21*b* from exceeding an allowable value $t_{max}$.

In the second embodiment, the rectangular-wave voltage with the superimposed high-voltage pulses is intermittently applied to a component which otherwise has a voltage, a current and/or a power consumption beyond a maximum rating of the component or has a temperature rise beyond an allowable range when the rectangular-wave voltage with the superimposed high-voltage pulses is continuously applied thereto in the non-lighted state of the discharge lamp 4. This makes it possible to limit the voltage, the current and/or the power to equal to or less than the maximum rating and to limit the temperature within the allowable range so as to achieve extended life duration of the entire device.

In the second embodiment, the resistor 21*b* as a component of the igniter circuit 31 is selected as a target for setting the operation-enabling time T1 and the interval time T2. However, a subject of the condition setting is not limited to the resistor 21*b*. The subject may be any other component which otherwise has a voltage, a current and/or a power consumption beyond a maximum rating of the component or has a temperature rise beyond an allowable range when the rectangular-wave voltage with the superimposed high-voltage pulses is continuously applied thereto in the non-lighted state of the discharge lamp 4.

Third Embodiment

A third embodiment of the present invention will be specifically described below. A feature of a lighting device according to the third embodiment (or a lighting apparatus equipped with the lighting device according to the third embodiment) is in that an automatic reset-type temperature responsive switch adapted to open and close contacts according to temperatures is used as first and second timers.

Figure 16:
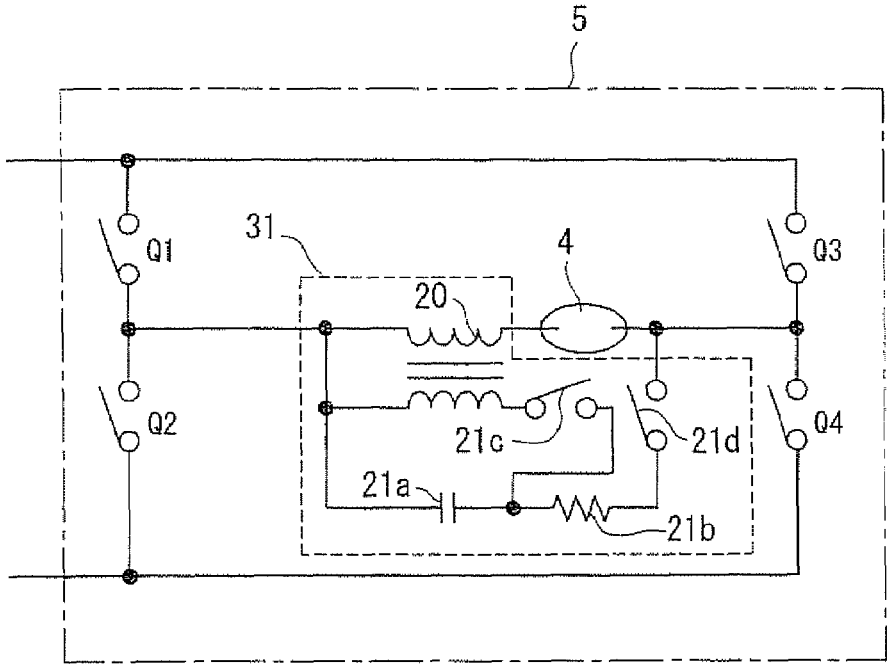
FIG. 16 is a circuit diagram of a polarity reversing circuit and an igniter circuit constituting a lighting device according to a third embodiment of the present invention.

As shown in FIG. 16, in the third embodiment, an automatic reset-type temperature responsive switch 21*d*, such as a thermal protector or a bimetal switch, is connected in series between a resistor 21*b* of the igniter circuit 31 and a discharge lamp 4. The temperature responsive switch 21*d* is arranged adjacent to the resistor 21*b*. The remaining circuit configuration is the same as that in the first embodiment, and its description will be omitted. The following description will be made with reference to the figures relating to the first embodiment where necessary.

Upon turn on of the AC power supply AC, the first control circuit 10 starts operating to activate the step-up chopper circuit 2. Simultaneously, the second control circuit 26 starts operating to activate the step-down chopper circuit 3 and the polarity reversing circuit 5, so that a rectangular-wave current flows to generate heat in the resistor 21*a* of the igniter circuit 31. The temperature responsive switch 21*d* is designed to close contacts thereof until a temperature of the resistor 21*b* increases beyond an operating temperature. Thus, the igniter circuit 31 is activated to superimpose high-voltage pulses on a rectangular-wave voltage. Then, when the temperature of the resistor 21*b* exceeds the operating temperature, the temperature responsive switch 21*d* opens the contacts. Thus, the igniter 31 is deactivated, and thereby no current flows. Subsequently, when the temperature of the resistor 21*b* falls below the operating temperature, the temperature responsive switch 21*d* closes the contacts, and thereby the igniter 31 is re-activated. That is, in the third embodiment, a period where the temperature responsive switch 21*d* closes the contacts corresponds to the operation-enabling time T1. Further, a period where the temperature responsive switch 21*d* opens the contacts corresponds to the interval time T2.

A target for temperature detection by the temperature responsive switch 21*d* arranged adjacent thereto is not limited to a component of the igniter circuit 31. The target may be any other component which generates a larger amount of heat during the operation-enabling time T1 in which the high-voltage pulses are superimposed on the rectangular-wave voltage, than that in the lighted state. A circuit position for inserting the temperature responsive switch 21*d* is not limited to the igniter circuit 31. The temperature responsive switch 21*d* may be arranged at any other position allowing the high-voltage pulses to be superimposed on the rectangular-wave voltage. Further, a bimetal switch adapted to open contacts based on self-heating may be used as the automatic reset-type temperature responsive switch 21*d*.

Fourth Embodiment

A fourth embodiment of the present invention will be specifically described below. Generally, when an arc tube of a discharge lamp (high-pressure discharge lamp) has a sufficient low internal temperature (initial start-up condition), it is necessary to excite a substance enclosed in the arc tube so as to make the transition to an arc discharge. Further, under the initial start-up condition, an electrode is also cooled, and thereby it is necessary to sufficiently warm up the electrode so as to allow thermal electrons to be adequately emitted. Therefore, under the initial start-up condition, a high-voltage-pulse application time required for transition to an arch discharge becomes longer as compared with that under a restart condition where the arc tube has a high temperature.

Figure 17:
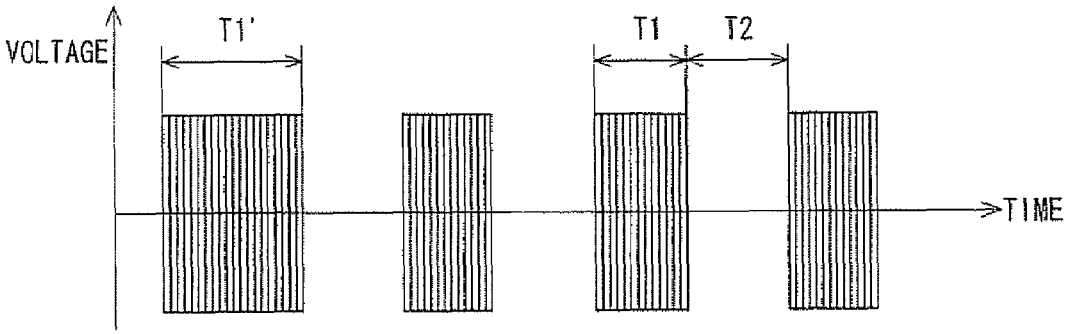
FIG. 17 is a chart showing an operation of a lighting device according to a fourth embodiment of the present invention.
Figure 18:
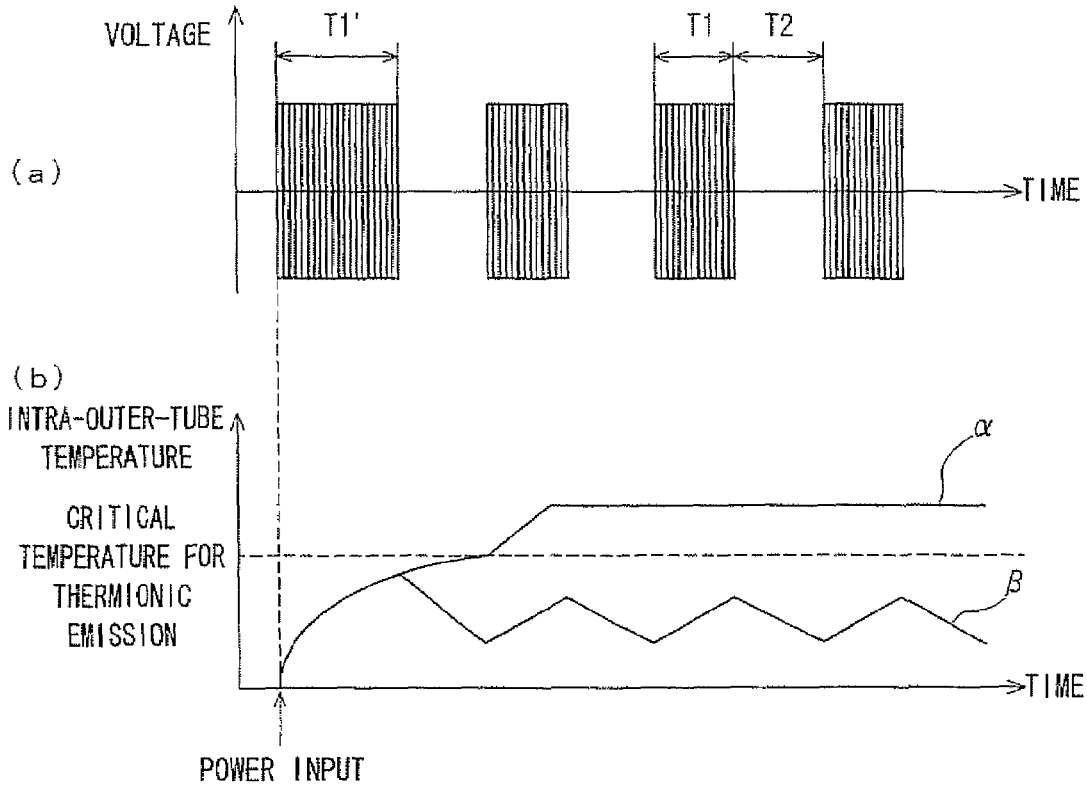
FIG. 18 is a chart showing the operation of the lighting device according to the fourth embodiment.

As shown in FIG. 17, in the fourth embodiment, an operation-enabling time T1' just after turning on power is set at a larger value than that of a subsequent operation-enabling time T1 to provide enhanced initial start-up performance. In view of the result of experimental tests and verifications, it is desirable to set the high-voltage-pulse application time during initial start-up (operation-enabling time T1') in the range of about 5 to 10 seconds As shown in the graph (b) of FIG. 18, in an abnormal discharge lamp where luminophor and other substance in an arc tube leaks in an outer tube (hereinafter referred to as "abnormal lamp"), an internal temperature of the outer tube is increased as the high-voltage pulses are applied for a longer time. Then, when the internal temperature of the outer tube exceeds a critical temperature for thermionic emission, arc-discharge transition occurs in the outer tube to cause an intra-outer-tube discharge (see the curve β in the graph (b) of FIG. 18). Thus, it is desirable to set the operation-enabling time T1, T1' and the interval time T2 in such as manner as to prevent occurrence of an intra-outer-tube discharge even in such an abnormal lamp.

On the conditions that the interval time T2 is set at a fixed value of 10 second, and the operation-enabling time T1 is changed from 2 second to 14 seconds at intervals of 2 seconds, the inventers conducted an experimental test for checking whether or not an intra-outer-tube discharge occurs in an abnormal lamp. In this test, the intra-outer-tube discharge did not occur in the operation-enabling time T1 set at 12 seconds or less, but at 14 seconds. Thus, in view of preventing the intra-outer-tube discharge, it is desirable to set the operation-enabling time T1, T1 at about 10 second or less.

Further, on the conditions that the operation-enabling time T1 is set at a fixed value of 10 second, and the interval time T2 is changed from 2 second to 14 seconds at intervals of 2 seconds, the inventers conducted another experimental test for checking whether or not an intra-outer-tube discharge occurs in an abnormal lamp. In this test, the intra-outer-tube discharge did not occur in the interval time T2 set at 6 seconds or more, but at 4 seconds or less. If the interval time T2 is excessively increased, and a discharge lamp does not start up within the first operation-enabling time T1, a user can misunderstand it to be a malfunction. Thus, it is desirable to set the interval time T2 at about 10 second or less As above, each of the operation-enabling time T1 and the interval time T2 can be set at about 10 seconds to prevent an intra-outer-tube discharge due to the internal temperature of the outer tube reaching the critical temperature for thermionic emission, even in an abnormal lamp.

Fifth Embodiment

A fifth embodiment of the present invention will be specifically described below.

Figure 19:
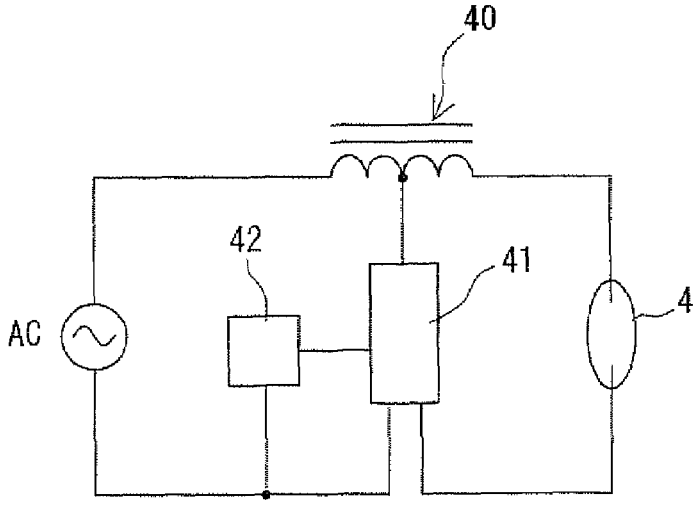
FIG. 19 is a circuit block diagram showing the configuration of a lighting device according to a fifth embodiment of the present invention.

As shown in FIG. 19, a lighting device according to the fifth embodiment comprises a current-limiting element (copper-iron ballast) 40 consisting of a choke coil inserted between an AC power supply AC and a discharge lamp 4, an igniter circuit 41 for applying start-up high-voltage pulses to the discharge lamp 4 through the current-limiting element 41, and a timer circuit 42 for controlling an operation of the igniter circuit 41.

As with the conventional device 1 disclosed in the Patent Publication 1, the igniter circuit 41 has a series circuit provided with a capacitor and a triac and connected between the AC power supply AC and a tap incorporated in the current-limiting element 40. When the triac is turned on by a voltage responsive element, a high-voltage pulse is generated from the current-limiting element 40. The timer circuit 42 is composed using a general-purpose timer IC etc., and designed to count the operation-enabling time T1, the interval time T2, the restart time T3, etc., and control an operation of the voltage responsive element and the triac depending on the respective times T1, T2, T3. Thus, in the same manner as that of the timer 29 in the first embodiment, the timer circuit 42 operates to allow the igniter circuit 41 to output high-voltage pulses therefrom only for the operation-enabling time T1 with the interval time T2 between the adjacent operation-enabling times T1.

Although not illustrated, this lighting device is provided with a turn on detection circuit 26*a* for discriminating whether or not the discharge lamp 4 is in its lighted state, based on a voltage to be applied from the current-limiting element 40 to the discharge lamp. When the turn on detection circuit 26*a* discriminates that the discharge lamp 4 is in the lighted state, the timer circuit 42 starts operating. Then, when the turn on detection circuit 26*a* discriminates that the discharge lamp 4 is in its non-lighted state, the timer circuit 42 stops operating.

Figure 20:
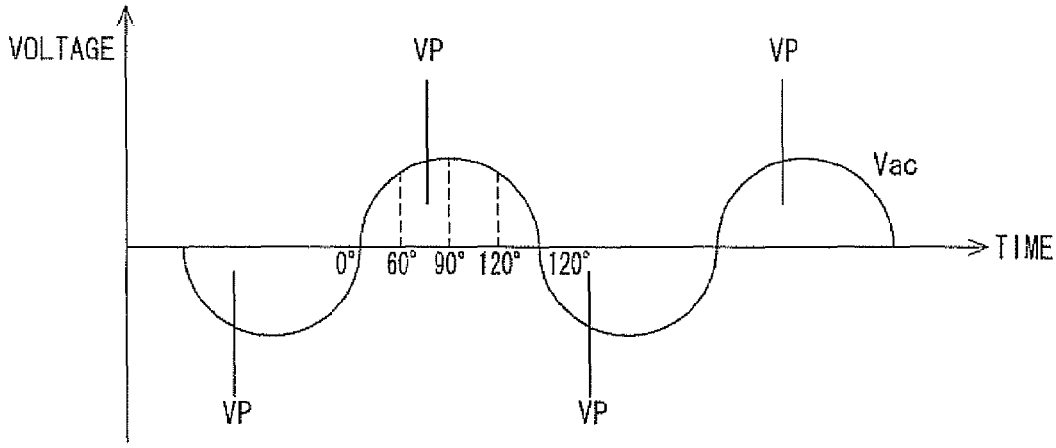
FIG. 20 is a chart showing an operation of the lighting device according to the fifth embodiment.

As shown in FIG. 20, this igniter circuit 41 is operable to output a single high-voltage pulse VP for each one-half cycle of a power supply voltage Vac of the AC power supply AC. In contrast, a conventional technique is designed to output a purity of high-voltage pulses for each one-half cycle of a power supply voltage to improve a start-up performance. In the conventional technique, if a glow discharge occurs in an abnormal lamp, an internal temperature of an outer tube becomes higher to increase the risk of causing transition to an intra-outer-tube discharge. According to the igniter circuit 41, a single high-voltage pulse VP can be output for each one-half cycle of the power supply voltage Vac so as to suppress power consumption in an abnormal lamp due to glow discharge while ensuring a minimum start-up performance.

Figure 21:
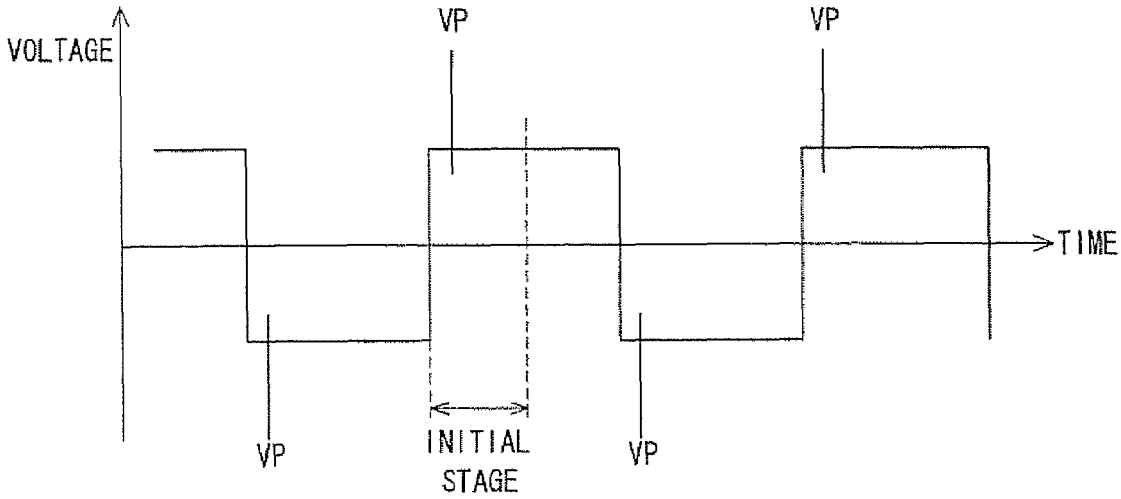
FIG. 21 is a chart showing an operation of a lighting device as one example of modification of the lighting device according to the fifth embodiment.

Similarly, in the aforementioned first embodiment, for each one-half cycle of the rectangular-wave voltage Vx to be output from the polarity reversing circuit 5 to the discharge lamp 4, a single high-voltage pulse VP may be superimposed on the rectangular-wave voltage Vx, as shown in FIG. 21, to obtain the same effect. Further, in order to provide enhanced start-up performance, the igniter 41 in the fifth embodiment may be designed to output the single high-voltage pulse VP around a peak of the power supply voltage Vac or in a phase angle range of 60 to 120 degrees. In the first embodiment, the single high-voltage pulse may be output just after a polarity of the rectangular-wave voltage is reversed. Alternatively, given that the one-half cycle is divided into an initial-half stage and a last-half stage, the single high-voltage pulse may be output in the initial-half stage.

Sixth Embodiment

A sixth embodiment of the present invention will be specifically described below. A feature of a lighting device according to the sixth embodiment (or a lighting apparatus equipped with the lighting device according to the sixth embodiment) is in that an igniter circuit is designed to generate high-voltage pulses through the use of a resonance voltage. The remaining configuration and operation are the same as those in the first embodiment.

Figure 22:
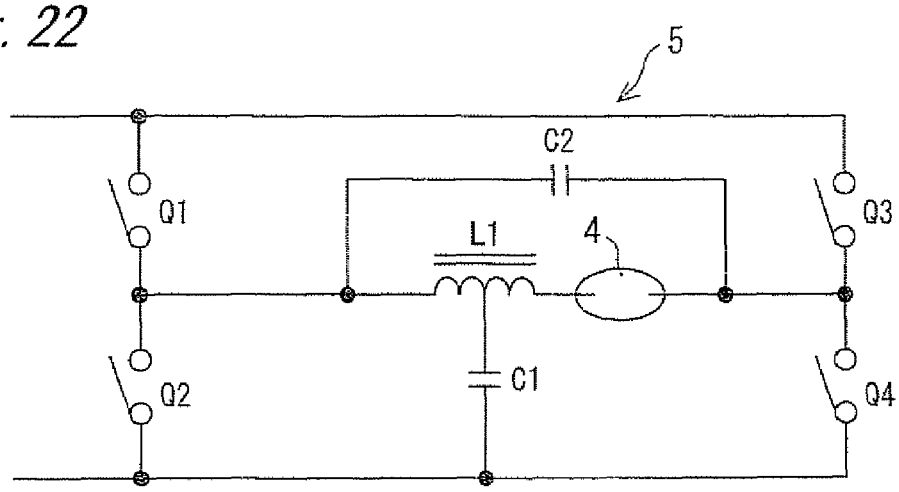
FIG. 22 is a circuit diagram of a polarity reversing circuit and an igniter circuit constituting a lighting device according to a sixth embodiment of the present invention.
Figure 23A:
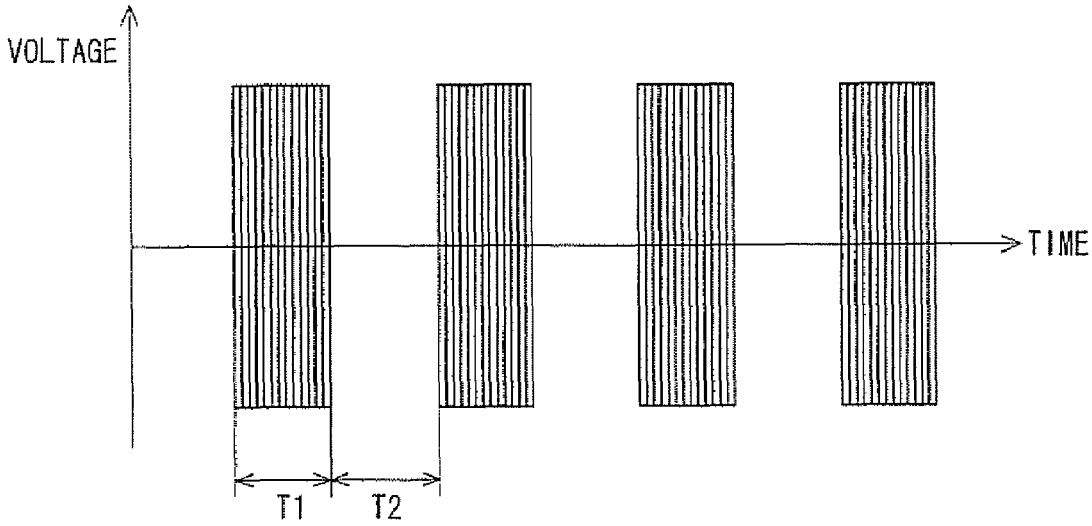
FIG. 23A is a chart showing an operation of the lighting device according to the sixth embodiment.

As shown in FIG. 22, an igniter circuit 31' in the sixth embodiment comprises a resonance circuit which includes an inductor L1 inserted between a polarity reversing circuit 5 and a discharge lamp 4, and a capacitance C1 inserted between the inductor L1 and the ground. Given that a resonance frequency of this resonance circuit is "f1", two switching elements Q1, Q2 of the polarity reversing circuit 5 are alternately turned on/off to charge the capacitor C1 when the switching element Q1 is in its ON state, and release charges from the capacitor C1 when the switching element Q2 is in its ON state. This resonance operation can be repeated for the operation-enabling time T1 with the interval time T2 between the adjacent operation-enabling times T1 to generate high-voltage pulses in the inductor L1, as shown in FIG. 23A.

Figure 23B:
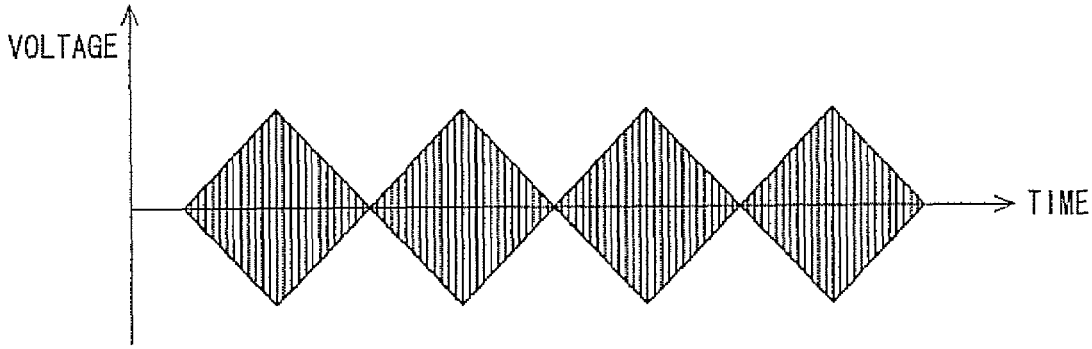
FIG. 23B is a chart showing the operation of the lighting device according to the sixth embodiment.

In the above configuration, if an inductance value of the inductor L1 and/or a capacitance value of the capacitor C1 have variations, the resonance frequency f1 will also vary. Thus, a switching frequency for the switch elements Q1, Q2 can be continuously changed within a given frequency range including the resonance frequency f1, or changed in a sweeping manner as shown in FIG. 23B, to generate high-voltage pulses using voltage peaks of the resonance circuit even if a component value (inductance value or capacitance value) varies. FIG. 23B is a waveform chart showing a resonance voltage (high-voltage pulses) swept in the operation-enabling time T1.

Figure 24A:
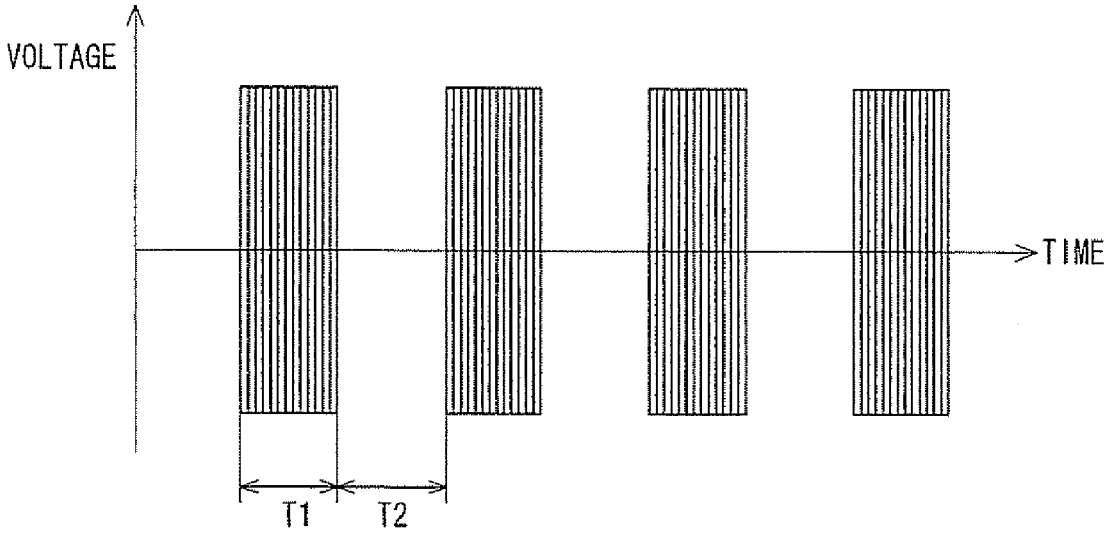
FIG. 24A is a chart showing an operation of a lighting device as one example of modification of the lighting device according to the sixth embodiment.
Figure 24B:
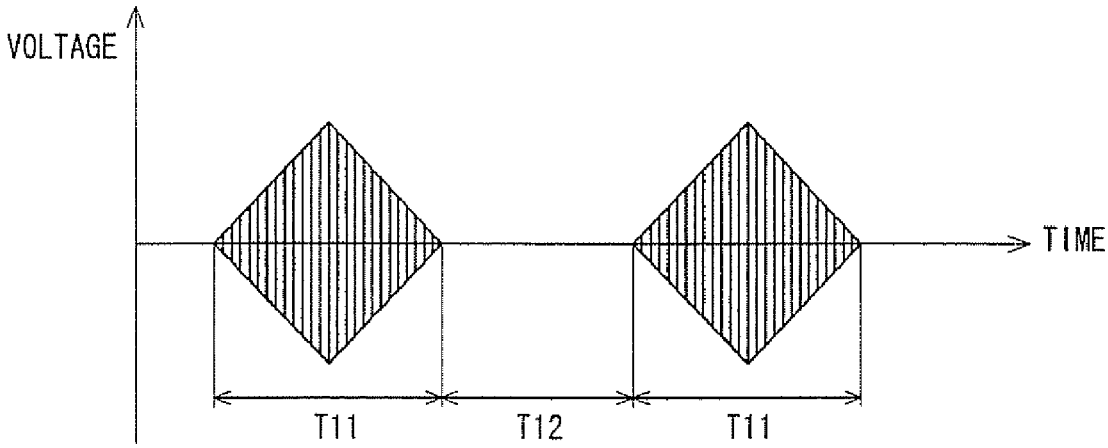
FIG. 24B is a chart showing an operation of a lighting device as another example of modification of the lighting device according to the sixth embodiment.

Further, as shown in FIGS. 24A and 24B, the operation-enabling time T1 may include a period T11 where high-voltage pulses are outputted and an interrupt period T12 where no high-voltage pulse is outputted, and the igniter circuit 31' may be intermittently activated. This makes it possible to suppress increase in internal temperature of the outer tube even if a glow discharge occurs in an abnormal lamp, so as to prevent the occurrence of an intra-outer-tube discharge. Each duration of the periods T11, T12 may be set by a timer 29. That is, the timer 29 serves as six and seventh timers.

While the present invention has been described in conjunction with specific embodiments thereof, various modifications and alterations will become apparent to those skilled in the art. Therefore, it is intended that the present invention is not limited to the illustrative embodiments herein, but only by the appended claims and their equivalents.

INDUSTRIAL APPLICABILITY

As mentioned above, the high-pressure discharge lamp lighting device of the present invention is effectively used as a lighting device capable of preventing abnormal heat generation even in occurrence of defects in a power feed line or discharge in an outer tube, and suitable for use in a lighting apparatus with a high-pressure discharge lamp, such as a high-intensity discharge lamp.

The invention claimed is:

1. A lighting device for a high-pressure discharge lamp comprising:

a lighting circuit for controlling at least one of voltage and current fed from an external power supply to the high-pressure discharge lamp so as to turn on the high-pressure discharge lamp;

an igniter circuit for applying start-up high-voltage pulses to the high-pressure discharge lamp;

a turn on detection circuit for detecting the lamp turn on;

a first timer which permits igniter circuit operation for a predetermined period if the high-pressure discharge lamp is not turned on;

a second timer which activates the first timer at a predetermined intermittent time interval repetitively;

a third timer which counts the time elapsed for restarting the high-pressure discharge lamp, and prohibits the operation of the igniter circuit after predetermined restarting time had reached;

a sixth timer which permits igniter circuit operation within said predetermined period of the first timer; and a seventh timer which activates the sixth timer at a predetermined intermittent time interval repetitively.

2. The lighting device according to claim 1 further comprising:

a fourth timer which counts a total time in which the high-voltage pulses are applied from the igniter circuit to the high-pressure discharge lamp according to respective operations of the first and second timers; and a fifth timer which, in place of the second timer, activates the first timer at a predetermined intermittent time interval greater than said time interval of the second timer repetitively, after the total time counted by the fourth timer exceeds a predetermined time.

3. A lighting apparatus comprising:

the lighting device according to claim 1;

a case for housing the lighting circuit and the igniter circuit;

a socket adapted to mechanically connected to a base of the high-pressure discharge lamp;

a lamp fitting including a reflector for reflecting light to be emitted from the high-pressure discharge lamp; and a cable including a plurality of electric wires each covered by an insulator, and a sheath having an insulting performance and covering the electric wires, wherein the lighting circuit and the igniter circuit are electrically connected to the socket through said cable.

4. The lighting device according to claim 1, wherein said predetermined period of the first timer and said time interval of the second timer are set in such a manner that output voltage of the lighting circuit in a non-lighted state of the high-pressure discharge lamp has an effective value less than a predetermined value.

5. The lighting device according to claim 1, wherein said predetermined period of the first timer and said time interval of the second timer are set in such a manner as to prevent overload beyond a maximum rating of a circuit component constituting the lighting circuit, the igniter circuit, the turn on detection circuit or the first to seventh timers when the high-pressure discharge lamp is not turned on.

6. The lighting device according to claim 5, wherein the maximum rating of the circuit component is at least one of a temperature rating, a current rating, a voltage rating and a power rating of said circuit component.

7. The lighting device according to claim 1, wherein each of the first and second timers consists of an automatic reset-type temperature responsive switch adapted to open and close contact in response to temperature.

8. The lighting device according to claim 1, wherein said predetermined period of the first timer just after initiation of the operation of the igniter circuit is set at a relatively large value.

9. The lighting device according to claim 8, wherein said predetermined period of the first timer just after initiation of the operation of the igniter circuit is set at a time sufficient for start-up of the high-pressure discharge lamp.

10. The lighting device according to claim 1, wherein said predetermined period of the first timer and said time interval of the second timer are set in such a manner as to prevent an intra-outer-tube discharge from occurring in the high-pressure discharge lamp.

11. The lighting device according to claim 1, wherein the lighting circuit consists of a copper-iron ballast.

12. The lighting device according to claim 11, wherein the igniter circuit outputs a single high-voltage pulse around a peak of an AC power supply voltage fed from the external power supply to the lighting circuit.

13. The lighting device according to claim 1, wherein the lighting circuit consists of an electronic ballast.

14. The lighting device according to claim 13, wherein the lighting circuit outputs a rectangular-wave alternating current, and the igniter circuit superimposes the start-up high-voltage pulses on an output rectangular-wave voltage from the lighting circuit.

15. The lighting device according to claim 14, wherein the igniter circuit superimposes a single one of the high-voltage pulses one time per one-half cycle of the output rectangular-wave voltage.

16. The lighting device according to claim 15, wherein, the one-half cycle of the output rectangular-wave voltage is divided into an initial-half stage and a last-half stage, the igniter circuit superimposes the single high-voltage pulse in the initial-half stage.

17. The lighting device according to claim 16, wherein the igniter circuit superimposes the single high-voltage pulse just after a polarity of the output rectangular-wave voltage is reversed.

18. The lighting device according to claim 13, wherein the igniter circuit generates the high-voltage pulses through the use of a resonance voltage.

19. The lighting device according to claim 1, which is such that a power is supplied from the lighting circuit to the high-pressure discharge lamp through a cable which comprises a plurality of electric wires each composed of a conductor having a thickness of 1 mm or less and an insulator covering the conductor, and a sheath having an insulting performance and covering the electric wires, wherein:

the lighting circuit outputs a rectangular-wave voltage alternating at a low frequency of several ten to several hundred Hz; and the igniter circuit superimposes a high-voltage pulse of 3 to 5 kV on the rectangular-wave output voltage from the lighting circuit.

20. The lighting device according to claim 1, wherein:

the high-pressure discharge lamp has a rated lamp power of 35 to 75 W;

said predetermined period of the first timer is set in the range of 3 to 5 seconds; and said time interval of the second timer is set in the range of 1 to 3 seconds.

21. The lighting device according to claim 1, wherein:

the high-pressure discharge lamp has a rated lamp power of 150 W;

said predetermined period of the first timer is set in the range of 0.5 to 1.5 seconds; and said time interval of the second timer is set in the range of 1 to 3 seconds.

22. A lighting device for a high-pressure discharge lamp comprising:

a lighting circuit for controlling at least one of voltage and current fed from an external power supply to the high-pressure discharge lamp so as to turn on the high-pressure discharge lamp;

an igniter circuit for applying start-up high-voltage pulses to the high-pressure discharge lamp;

a turn on detection circuit for detecting the lamp turn on;

a first timer which permits igniter circuit operation for a predetermined period if the high-pressure discharge lamp is not turned on;

a second timer which activates the first timer at a predetermined intermittent time interval repetitively; and a third timer which counts the time elapsed for restarting the high-pressure discharge lamp, and prohibits the operation of the igniter circuit after predetermined restarting time had reached;

wherein each of the first and second timers consists of an automatic reset-type temperature responsive switch adapted to open and close contact in response to temperature.

23. A lighting device for a high-pressure discharge lamp comprising:

a lighting circuit for controlling at least one of voltage and current fed from an external power supply to the high-pressure discharge lamp so as to turn on the high-pressure discharge lamp;

an igniter circuit for applying start-up high-voltage pulses to the high-pressure discharge lamp;

a turn on detection circuit for detecting the lamp turn on;

a first timer which permits igniter circuit operation for a predetermined period if the high-pressure discharge lamp is not turned on;

a second timer which activates the first timer at a predetermined intermittent time interval repetitively; and a third timer which counts the time elapsed for restarting the high-pressure discharge lamp, and prohibits the operation of the igniter circuit after predetermined restarting time had reached;

wherein said predetermined period of the first timer and said time interval of the second timer are set in such a manner that output voltage of the lighting circuit in a non-lighted state of the high-pressure discharge lamp has an effective value less than a predetermined value.

* * * * *